US005912626A

United States Patent [19]

Soderlund

[11] Patent Number: 5,912,626

[45] Date of Patent: Jun. 15, 1999

[54] DANGEROUS CONDITION WARNING DEVICE INCORPORATING PROVISION FOR PERMANENTLY RETAINING PRINTED PROTOCOL INSTRUCTIONS

[76] Inventor: Ernest E. Soderlund, 39W089 Adobe Ridge Dr., Elgin, Ill. 60123

[21] Appl. No.: 08/948,855

[22] Filed: Oct. 10, 1997

Related U.S. Application Data

[60] Provisional application No. 60/038,277, Feb. 19, 1997.

[51] Int. Cl.[6] ..... G08B 23/00

[52] U.S. Cl. ..... 340/693.5; 340/632; 340/693.11

[58] Field of Search ..... 340/693.5, 693.6, 340/693.9, 693.11, 693.1, 632; 40/124.06, 124.01; 283/74, 81

[56] References Cited

U.S. PATENT DOCUMENTS

| | | | |
|---|---|---|---|
| Re. 33,920 | 5/1992 | Tanguay et al. | 340/628 |
| 3,927,375 | 12/1975 | Lanoe et al. | 340/693 X |
| 3,932,850 | 1/1976 | Conforti et al. | 340/527 |
| 4,020,479 | 4/1977 | Conforti et al. | 340/511 |
| 4,091,363 | 5/1978 | Siegel et al. | 340/513 |
| 4,097,851 | 6/1978 | Klein | 340/628 |
| 4,138,664 | 2/1979 | Conforti et al. | 340/507 |
| 4,138,670 | 2/1979 | Schneider et al. | 340/507 |
| 4,139,846 | 2/1979 | Conforti | 340/636 |
| 4,225,860 | 9/1980 | Conforti | 340/629 |
| 4,258,261 | 3/1981 | Conforti | 250/381 |
| 4,287,517 | 9/1981 | Nagel | 340/636 |
| 4,302,753 | 11/1981 | Conforti | 340/628 |
| 4,583,072 | 4/1986 | Matsushita | 340/457 |
| 4,647,219 | 3/1987 | Figler et al. | 374/1 |
| 4,829,283 | 5/1989 | Spang et al. | 340/506 |
| 4,870,395 | 9/1989 | Belano | 340/693 |
| 4,884,065 | 11/1989 | Crouse et al. | 340/632 |
| 4,965,556 | 10/1990 | Brodecki et al. | 340/628 |
| 4,992,965 | 2/1991 | Hölter et al. | 340/634 X |
| 5,034,725 | 7/1991 | Sorensen | 340/632 |
| 5,063,164 | 11/1991 | Goldstein | 436/169 |
| 5,066,466 | 11/1991 | Hölter et al. | 340/632 X |
| 5,095,300 | 3/1992 | Alexander et al. | 340/686 |
| 5,103,216 | 4/1992 | Sisselman | 340/693 |
| 5,122,782 | 6/1992 | Kawahara | 340/540 |
| 5,172,096 | 12/1992 | Tice et al. | 340/501 |
| 5,252,949 | 10/1993 | Kirby et al. | 340/632 |
| 5,280,273 | 1/1994 | Goldstein | 340/632 |
| 5,422,629 | 6/1995 | Minnis | 340/630 |
| 5,440,293 | 8/1995 | Tice | 340/568 |
| 5,473,167 | 12/1995 | Minnis | 250/573 |
| 5,483,222 | 1/1996 | Tice | 340/518 |
| 5,517,182 | 5/1996 | Yasunaga | 340/634 |
| 5,682,145 | 10/1997 | Sweetman et al. | 340/632 |
| 5,694,118 | 12/1997 | Park et al. | 340/632 |
| 5,764,150 | 6/1998 | Fleury et al. | 340/634 X |

*Primary Examiner*—Thomas Mullen
*Attorney, Agent, or Firm*—Terrence Martin; Jules Jay Morris; Sean Detweiler

[57] ABSTRACT

A dangerous condition warning device issues an alarm when a sensed dangerous condition exceeds a predetermined status and has an associated card carrying imprinted protocol and instruction information which is intended to be permanently linked with the device for future reference. The card has first and second generally parallel side edges and a third edge including a tab and is fabricated from a durable and flexible material. A device housing is detachably attachable to a supporting surface for operational mounting. The housing includes a base member having an outside surface including a rear facing portion disposed adjacent the supporting surface when the device is installed for normal operation and a label area in the rear facing portion. The label area includes first and second generally parallel, mutually facing slots suitably spaced apart to retain the card when the first and second side edges of the card are inserted therein. Thus, the card can be permanently stored with the housing by sliding it into the slots before attaching the housing to the supporting surface such that the card can later be accessed by detaching the housing from the supporting surface and withdrawing the card from the slots using the tab.

9 Claims, 15 Drawing Sheets

DANGEROUS CONDITION WARNING DEVICE INCORPORATING PROVISION FOR PERMANENTLY RETAINING PRINTED PROTOCOL INSTRUCTIONS

CROSS REFERENCE TO RELATED PROVISIONAL APPLICATION

This application claims the benefit of the filing date of U.S. Provisional patent application Ser. No. 60/038,277 filed Feb. 19, 1997, entitled DANGEROUS CONDITION WARNING DEVICE by William P. Tanguay and Ernest Soderlund.

FIELD OF THE INVENTION

The present invention relates generally to devices for generating warnings of the presence of dangerous conditions, such as fire or combustion products or carbon monoxide, in an enclosed space such as a home or office.

BACKGROUND OF THE INVENTION

In general, devices for detecting and generating a warning with respect to dangerous conditions, such as the presence of combustion products or carbon monoxide, are known. For example, various smoke detector systems are described in U.S. Pat. Nos.: RE 33,920, reissued on May 12, 1992, to Tanguay et al; U.S. Pat. No. 4,870,395 issued Sep. 26, 1989, to Belano; and U.S. Pat. No. 4,965,556 issued Oct. 23, 1992, to Brodecki et al, all the foregoing referenced patents being commonly assigned with the present invention.

Other examples of such detectors are described in U.S. Pat. Nos.: 3,932,850 issued to Conforti et al on Jan. 13, 1976; 4,020,479 issued to Conforti et al on Apr. 26, 1977; 4,091,363 issued to Siegel et al on May 23, 1978; 4,097,851 issued to Klein on Jun. 27, 1978; 4,225,860 issued to Conforti Sep. 30, 1980; 4,258,261 issued to Conforti on Mar. 24, 1981; 4,302,753 issued to Tice on Aug. 8, 1995; 5,473,167 issued to Minnis on Dec. 5, 1995; 5,483,222 issued to Tice on Jan. 9, 1996; 4,097,851 issued to Klein on Jun. 27, 1978; 4,138,664 issued to Conforti on Feb. 6, 1979; 4,138,670 issued to Schneider et al on Feb. 6, 1979; 4,139,846 issued to Conforti on Feb. 13, 1979; 4,225,860 issued to Conforti on Sep. 30, 1980; 4,287,517 issued to Nagel on Sep. 1, 1981; 4,829,283 issued to Spang et al on May 9, 1989; 5,172,096 issued to Tice et al on Dec. 15, 1992; 5,422,629 issued to Minnis on Jun. 6, 1995; and 5,440,293 issued to Tice on Aug. 8, 1995.

Most combustion product detectors employ ionization chamber and/or photoelectric sensors. Carbon monoxide (CO) detectors are also known. In general, CO detectors employ one of three types of detectors: semiconductor, biomimetic and electrochemical.

Semiconductor CO sensors typically employ a thin layer of metal, such as tin dioxide, maintained at a relatively high temperature (e.g., 100° C. to 400° C.). The surface conductivity of the metal varies generally proportionally in accordance with exposure to ambient CO concentration. The semiconductor chip measures the migration of oxygen molecules through the surface of the sensor material. Such semiconductor CO sensors have drawbacks in that they have relatively high power requirements and are therefore not practical for battery units. In addition, many semiconductor CO sensors require high temperature (e.g., 400° C.) purging to burn off attracted CO on a periodic basis; e.g., every 2.5 minutes. There is also difficulty in determining the efficiency or working condition of semiconductor CO sensors; self-diagnostic tests are not generally available. In addition, semiconductor CO sensors tend to be sensitive to other gases in addition to carbon monoxide, giving rise to a potential for false alarms, and sensor accuracy can drift substantially (up to 40%) over time.

Biomimetic sensors utilize a transparent substrate disk coated with a synthetic hemoglobin that mimics the reaction of natural hemoglobin in the presence of carbon monoxide. The biomimetic material darkens with cumulative absorption of CO. A light emitting diode (LED) transmits light through the biomimetic material to a photosensitive device. When the material becomes sufficiently dark to prevent adequate light from reaching the photosensitive device, the detector sounds an alarm. An example of a biomimetic sensor is described in U.S. Pat. No. 5,063,164 issued to Goldstein on Nov. 5, 1991.

Biomimetic sensor based systems are disadvantageous in a number of respects. The time period necessary for the sensor to recover from exposure to carbon monoxide is relatively long time (e.g., 24 to 48 hours). Thus, assuming that the alarm system is silenced until the sensor recovers, the occupants of the home are unprotected during that period. In addition, exposure to particularly high levels of CO can permanently darken the sensor. Further, biomimetic sensors are susceptible to generating false alarms because their self-diagnostic capabilities tend to be limited.

Electrochemical sensors, in general, employ a chemical reaction to convert CO to carbon dioxide ($CO_2$) to create a chemical imbalance in a portion of the cell which in turn generates a current indicative of the amount of CO present. Some electrochemical sensors utilize two chambers (one for CO and one for hydrogen). However, calibration of the sensor is required, and self-diagnostic capabilities tend to be limited.

Various standards have been set with respect to the performance of dangerous condition alarms for residential use. For example, Underwriters Laboratory (UL) in the United States and Canada have promulgated standards UL 217, ULC-S531, UL 268 and ULC-S529 with respect to smoke detectors and UL 2034 (effective Oct. 1, 1995) with respect to CO detectors.

UL standards for dangerous condition alarm systems for residential use typically define certain alarm conditions. For example, UL 2034, requires that a CO detector generate an alarm in response to cumulative exposure to CO concentrations at specified levels measured in parts per million (PPM) within predetermined time periods (e.g., sound an alarm at 100 PPM in less than 90 minutes, 200 PPM in less than 35 minutes and 400 PPM in less than 15 minutes). However, in order to reduce nuisance alarms, the UL standard also requires that a CO detector ignore cumulative exposure to various low concentrations of CO for minimum time periods (e.g. 15 PPM for up to 30 days, with additional exposure to 35 PPM for one hour twice a day to simulate potential cyclical changes in CO levels resulting from vehicle traffic, 60 PPM for up to 28 minutes, and 100 PPM for up to 16 minutes).

In addition, UL standards sometimes require that dangerous condition alarms incorporate some manner of manually actuable reset button. For example, UL 2034 requires that a CO detector include a manually actuable reset button which, in effect, decreases the sensitivity of the device and turns off the alarm for a predetermined time period. If the CO concentration is maintained or continues to rise at the conclusion of the reset period (defined by UL 2034 as being a maximum of six minutes), then the alarm will be reactuated.

UL standards often also require that dangerous condition alarm devices be marked with specific warning and/or operating instructions. For example, UL 2034 requires that a CO detector be marked with certain operating instructions which set forth a particular protocol to be followed in the event that the alarm sounds. The instructions advise the occupant to call the fire department only if someone is experiencing symptoms of CO poisoning (headache, dizziness, upset stomach, etc.). If no CO poisoning symptoms are present, the occupant is instructed to reset (silence) the detector and investigate the source of the CO.

Given the nature of the dangers protected against by such dangerous condition warning devices, it is particularly important that the sensors be reliable and relatively foolproof. This need is accentuated when the unit employs a DC power source and/or replaceable sensor unit. It is therefore important to ensure that replaceable units be installed properly, (e.g., are not reversed during installation), are in good operating condition, and that an occupant be given sufficient warning of an impending sensor or battery failure. In general, generation of a low battery warning signal is known. Examples of apparatus for generating an alarm to indicate impending battery failure in the context of a battery powered fire detector are described in U.S. Pat. No. : 4,139,846 issued to Conforti on Feb. 13, 1979; 4,138,670 issued to Schneider et al on Feb. 6, 1979; and 4,138,664 issued to Conforti et al on Feb. 6, 1979.

Another source of frustration with dangerous condition detectors is the inability of the typical user to discern which of a number of detector units is generating warning signals as to impending battery or sensor failure. Conventionally, a low battery warning signal is generated by intermittent actuation of the same horn used to generate a danger condition alarm. The low battery warning signal is distinguishable from a danger condition alarm by the duty cycle and/or repetition rate. However, it is often very difficult to localize sound. This difficulty tends to be exacerbated when the units are mounted in inaccessible places such as, for example, on a cathedral ceiling, or are mounted in close proximity to other devices, such as other dangerous condition detectors (e.g., a CO detector mounted near a smoke alarm). Some detectors also include a visual indicator, such as an LED, that blinks in synchronization with the low battery audible alarm, albeit not coincidentally. However, to conserve battery power, the LED activation is held to a relatively short duration, e.g., 10 milliseconds, and the repetition rate is typically kept relatively low, e.g., one flash each 40 seconds. As a result, unless the user happens to be looking in the direction of the unit when the LED flashes or is able to correlate a 10 millisecond flash with a 10 millisecond chirp delayed by several seconds, it is difficult to identify the particular unit in distress.

Because of the ongoing importance of permanently retaining instruction and protocol information with a dangerous condition warning device, particularly a CO concentration monitoring and alarm device, it is essential that a card on which the instruction and protocol information is maintained readily accessible, but securely stored with the dangerous condition warning device, and it is to a particularly effective implementation of this feature that the present invention is directed.

OBJECTS OF THE INVENTION

It is therefore a broad object of this invention to provide a dangerous condition warning device in which special provision is made for the long term retention of instruction and protocol information.

It is a more specific object of this invention to provide such a feature in which the instruction and protocol information is printed on a detachable card which is readily accessible, but is securely stored with the dangerous condition warning device.

SUMMARY OF THE INVENTION

These and other objects of the invention are achieved in a dangerous condition warning device adapted to issue an alarm when a sensed dangerous condition exceeds a predetermined status, which dangerous condition monitoring device has associated therewith protocol and instruction information which are intended to be permanently linked with the dangerous condition warning device for future reference. The protocol and instruction information is imprinted on a card having first and second generally parallel side edges and a third edge including a tab, the card being fabricated from a durable and flexible material. A housing for the dangerous condition warning device is detachably attachable to a supporting surface for operational mounting. The housing includes a base member having an outside surface including a rear facing portion disposed adjacent the supporting surface when the dangerous condition warning device is installed for normal operation and a label area in the rear facing portion. The label area includes first and second generally parallel, mutually facing slots suitably spaced apart to retain the card when the first and second side edges of the card are inserted therein. Thus, the card can be permanently stored with the housing by sliding it into the slots before attaching the housing to the supporting surface such that the card can later be accessed by detaching the housing from the supporting surface and withdrawing the card from the slots using the tab.

BRIEF DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DETAILED DESCRIPTION OF PREFERRED EXEMPLARY EMBODIMENTS

Figure 1:
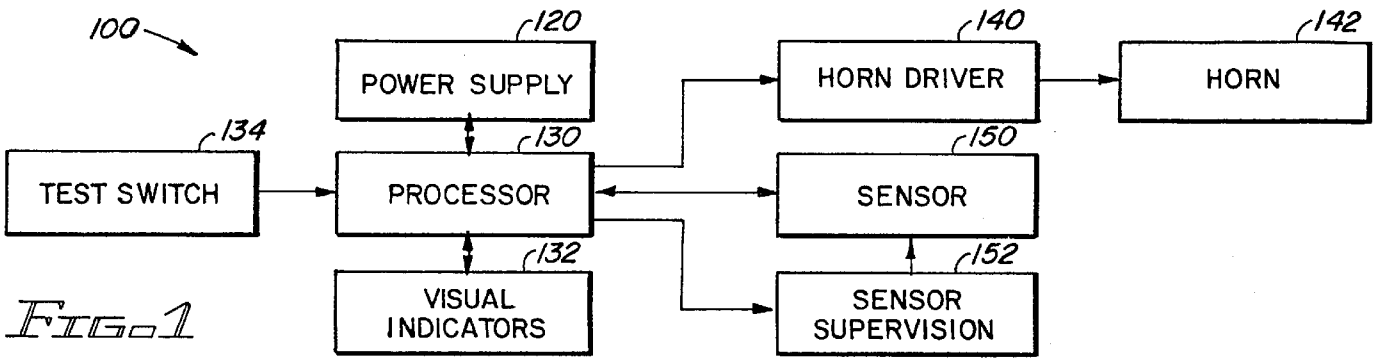
FIG. 1 is a block schematic diagram of a dangerous condition detector unit in accordance with the present invention.

Referring now to FIG. 1, a dangerous condition detector unit 100 in accordance with the present invention includes: a power supply 120; a processor 130; respective visual indicators 132; a manually actuable test/reset switch 134; a suitable audio transducer (e.g., piezoelectric horn 142) and cooperating horn driver 140; a suitable sensor 150 and a sensor supervision system 152.

Power supply 120 may be any supply capable of providing the necessary voltage levels for the various components of the system. In circumstances where AC line voltage is available, power supply 120 suitably includes a conventional diode bridge rectifier and voltage regulator devices. Battery back-up may also be provided. Alternatively, power supply 120 may employ a battery as the primary power source.

Figure 2:
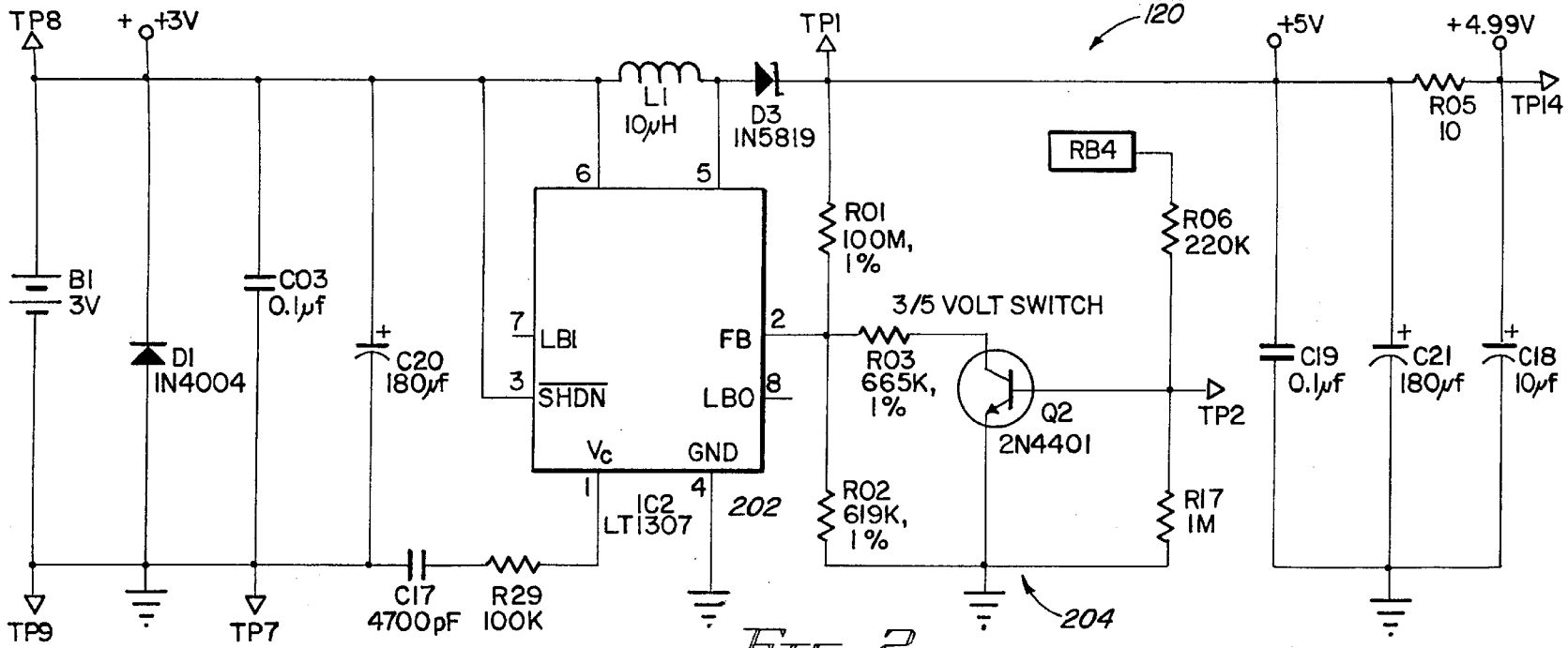
FIG. 2 is a schematic diagram of an exemplary DC power supply.

However, with the DC configuration, it is desirable that provisions be made to conserve power (battery savings) and to account for decreases in battery voltage over the life of the battery. For example, referring to FIG. 2, an exemplary DC power supply includes a battery B1 (e.g. two AA 1.5 volt alkaline cells connected to provide 3.0 volts DC), a conventional DC-to-DC converter 202 and a suitable switching circuit 202. Preferably, a diode D1 is also provided across battery B1 to prevent damage to unit 100 in the event that the battery is inserted with reversed polarity. An output capacitance (C19, C21, C18) is conventionally provided to reduce noise and ripple voltage in the output.

DC-to-DC converter 202 generates a relatively stable predetermined voltage appropriate for energizing the various components of the unit, irrespective of a relatively wide range of variation in the output of battery B1 (e.g. down to approaching 1.0 volts) as the batteries are depleted. The predetermined output voltage of DC-to-DC converter 202 is suitably stepped up from the battery voltage, e.g. to between about 3.0 v to 5.0 v, to accommodate the requirements of the various components. DC-to-DC converter 202 may be based on, for example, a Linear Technology LT1307 Single Cell Micropower Pulse Width Modulated DC/DC Converter Chip.

Switching circuit 204 selectively actuates converter 202 in accordance with control signals from processor 130 and includes a transistor Q2 disposed to selectively provide a limited current path between the feedback pin (FB; pin 2) of DC-to-DC converter 202 and ground. As will be discussed, processor 130 provides a control signal (RB4) to selectively render transistor Q2 conductive, placing resistor R03 in parallel with resistor R02 and thus pulling the FB terminal of converter 202 towards ground and, in effect, modifying the output voltage of converter 202. In essence, to conserve power, sensor 150 is monitored only for a relatively short period of predetermined duration, e.g., 30 milliseconds and is polled only periodically, e.g., approximately every 48 seconds. Converter 202 is similarly switched to a higher voltage only on a periodic basis, e.g. in conjunction with operation of sensor 150 while any of the visual indicators 132 are illuminated or during the time of horn activity 140, 142. During the period when the sensor is monitored, DC-to-DC converter 202 provides a relatively stable 5.0 volt output for application to the various components of the system. At all other times, DC-to-DC converter 202 provides an output of about 3.0 volts which is suitable for ongoing operation of the processor 130.

Sensor 150 may be any sensor compatible with the available power supply and processor which is capable of providing a suitable signal in response to designated conditions. For example, in the context of an AC line powered CO detector unit, sensor 150 may employ a conventional semiconductor sensor. More specifically, referring to FIG. 3A, sensor 150 incorporates: a semiconductor CO sensor unit 302, such as a Capteur 1CGL05ALB07; a suitable heater driver circuit 304; precision reference voltage dividers 306 and 308; and respective amplifiers 310 and 312.

Figures 3A, 3B:
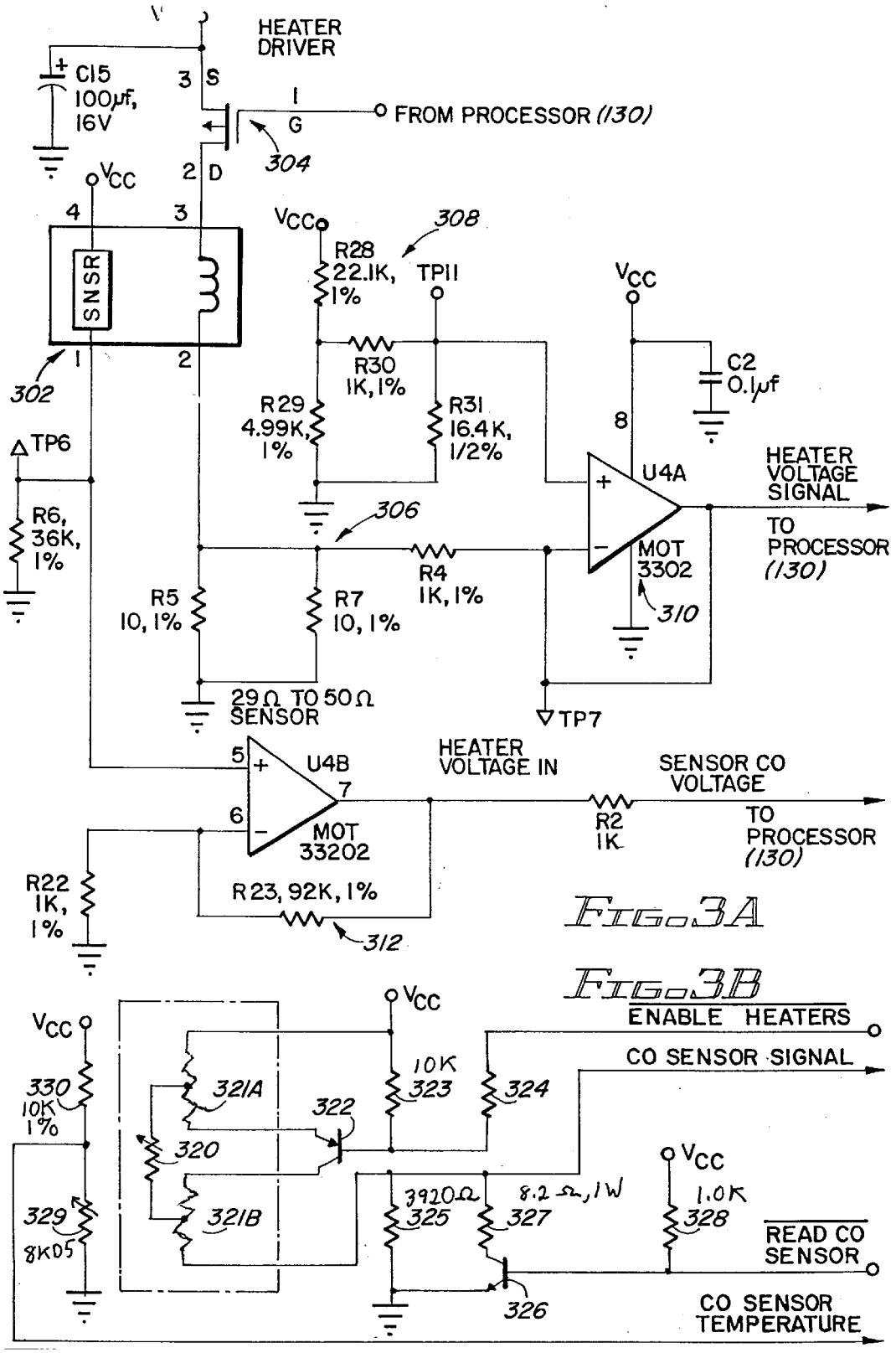
FIG. 3A is a schematic diagram of a suitable sensor circuit for use in an AC powered unit.
FIG. 3B is a schematic diagram of an alternative sensor circuit for use in an AC powered unit.

Alternatively, the sensor circuit shown in FIG. 3B may be employed in an AC line powered CO detector unit. In this embodiment, the CO sensor 150 incorporates a CO sensor device 320 which is a non-replaceable semiconductor tin oxide sensor, a Figaro TGS 203 in the example. Heaters 321A and 321B are cooperatively energized to heat the CO sensor device 320 to an appropriate temperature range. Thermistor 329, disposed in close thermal contact with the CO sensor device 320, is connected in series with precision resistor 330 between VCC and ground such that the voltage appearing at the junction is representative of the instantaneous temperature in the proximity of the CO sensor device. This signal is sent to the processor 130 as previously described. The integrity of the thermistor 329 is checked periodically (typically, every few seconds) to ensure its integrity; if its resistance is determined to be out of range, as when it has opened or shorted, then the processor will initiate a Fault mode.

The heaters 321A, 321B are energized by the cooperation of PNP power transistor 322 and NPN power transistor 326. Transistor 322 is biased normally-off by pull-up resistor 323 connected between the base of the transistor and VCC. Conversely, transistor 326 is biased normally on by pullup resistor 328 connected between the base of the transistor and VCC. Thus, current flow through the heaters 321A, 321B is controlled by applying, through isolation resistor 324, a low signal to the base electrode of transistor 322 and allowing a high signal to be applied to the base electrode transistor 326 through resistor 328, thereby establishing a current path from VCC through the heater 321A, through transistor 322, through heater 321B, through power resistor 327 (e.g., 8.2Ω, 1W) and through transistor 326 to ground. Resistor 325 is of much higher resistance (e.g., 3.92KΩ) than power resistor 327 such that negligible heater current flows through it.

The current through the heaters is subject to pulse-width modulation by periodically applying a low signal to the base of the transistor 322. In the example, a 73% duty cycle is used for a high heat purge and a 13% duty cycle for a low heat mode prior to reading the CO sensor device 320.

The CO sensor device 320 is read by placing a low signal on the base of transistor 326 to turn it off and a high signal on the base of transistor 322 to turn it off, thus de-energizing the heaters 321A, 321B. In this state, the CO sensor device 320 is disposed in series with resistor 325 between VCC and ground such that the voltage appearing at their junction is indicative of the resistance of the CO sensor device which is, in turn, representative of the ambient CO concentration. (The resistance of the tin oxide type semiconductor sensor device decreases with an increase in CO concentration such that a higher voltage appearing at the above-mentioned junction denotes a corresponding increase in CO concentration.) This signal is sent to the processor as previously described.

Figure 4:
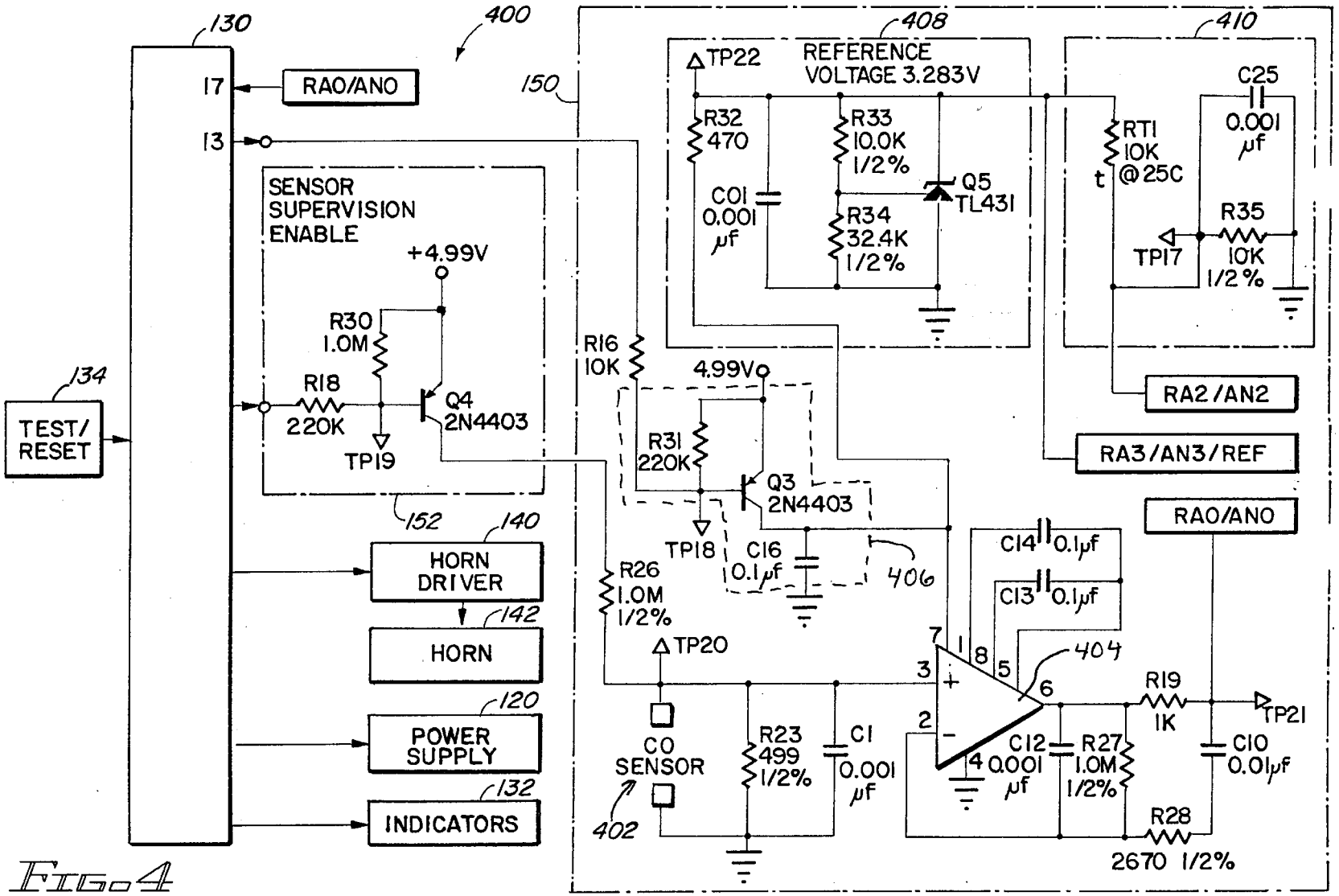
FIG. 4 is a block/schematic diagram of a battery powered CO detector unit in accordance with various aspects of the present invention.

In a battery powered CO detector unit, sensor 150 preferably employs a small low-power electrochemical sensor device. Referring to FIG. 4, battery powered CO detector unit 400 employs a sensor 150 incorporating: an electrochemical CO sensor device 402; a load resistor R23 of predetermined resistance; an amplifier 404; a suitable sensor/reference enable circuit 406; reference voltage generator 408; and temperature sensor circuit 410.

CO sensor device 402 is preferably a two terminal device that generates a signal (voltage or current) indicative of substantially instantaneous exposure to carbon monoxide. In essence, the CO sensor device 402 is in the nature of a battery combined with a capacitor, with respective parallel conductive plates separated by an electrolyte. The conductive plates are treated with a catalyst, e.g., platinum black, to provide a large surface area. When a carbon monoxide molecule impinges upon the detector, the CO is, in simplistic terms, oxidized, generating carbon dioxide ($CO_2$) plus two electrons. The resulting electron flow effects a current indicative of the instantaneous level of ambient CO, and the current is applied to load resistance R23 to develop a voltage. Load R23 is suitably a relatively low resistance, high precision resistor (e.g., 499 ohms, ½%).

The currents and voltages generated and developed in this manner are relatively low level. For example, the voltage developed across the precision resistor R23 is on the order of 1.8 millivolts per 100 PPM of CO present. Accordingly, amplifier 404 is employed to generate a signal (RA0/AN0) which is both indicative of the instantaneous level of CO and of a level compatible with processor 130. Amplifier 404 is preferably a high gain operational amplifier circuit such as a chopper amplifier.

As previously noted, it is particularly desirable to conserve power in battery powered units. Accordingly, amplifier 404 is preferably activated only on an intermittent basis., e.g., activated for a relatively short period, such as 30 milliseconds, at periodic intervals such as about every 48 seconds. To this end, sensor 150 preferably includes sensor/reference enable circuit 406 for selectively activating amplifier 404 in response to signals from processor 130. Sensor enable circuit 406 employs a transistor Q3 as a switch to control the application of power from supply 120 to amplifier 404 and reference voltage generator 408. Reference voltage generator 408 develops a reference signal (RA3/AN3/REF) provided to processor 130 for use in connection with analog-to-digital conversion of the output RA0/AN0 (the signal indicative of the ambient CO level) of amplifier 404.

Figure 5:
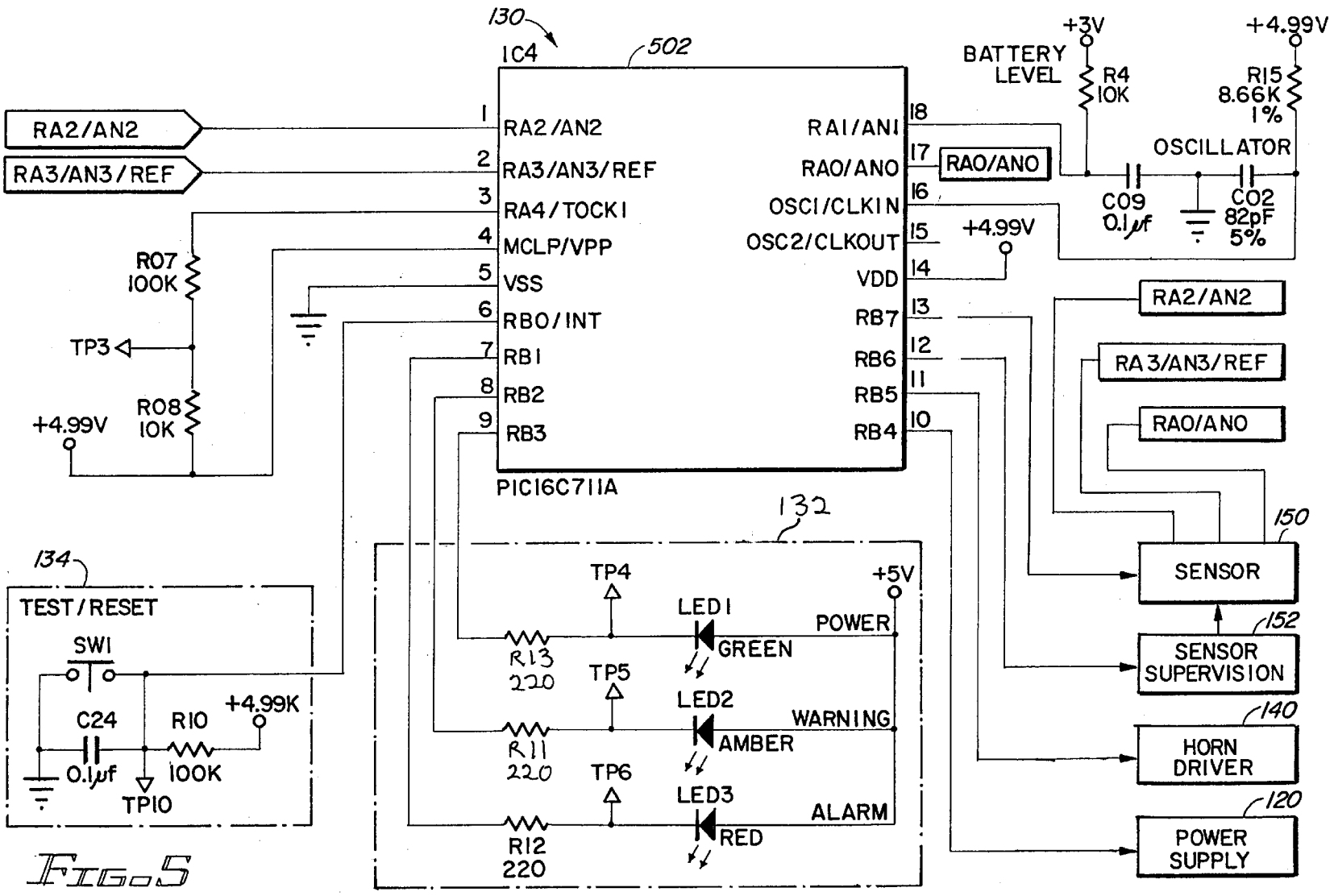
FIG. 5 is a block/schematic diagram of the system of FIG. 4 showing a processor, a test reset switch and visual indicators in more detail.

Referring now to FIGS. 4 and 5, a processor 130 suitable for use in a DC powered CO detector includes a conventional, commercially available processor 502. Processor 502 may be, for example, a Microchip type PIC16C711A which incorporates an internal read only memory (e.g. an electronically programmable memory or EPROM), a random access memory (RAM), an analog-to-digital (A/D) converter and both analog and digital input/output (I/O) facilities.

Processor 502 is receptive of (in addition to clock and power signals): CO level signal RA0/AN0 from amplifier 404 (applied at pin 17), indicative of the level of ambient carbon monoxide; reference voltage RA3/AN3/REF from circuit 408 (applied at pin 2) used in connection with A/D conversion of CO level signal RA0/AN0; a signal RA2/AN2 indicative of temperature from temperature compensation circuit 410 (applied at pin 1); a suitable interrupt signal RB0/INT from test/reset switch 134 (applied at pin 6); and a signal RA1/AN1 indicative of the battery level (applied at pin 18). As will be explained further below, reference voltage RA3/AN3/REF from circuit 406 (applied at pin 2) is, in effect, synchronized with the operation of amplifier 404.

Processor 502, in turn, provides control signals: to sensor 150 (pin 13, RB7); to sensor/reference enable circuit 406 (pin 13, RB7) to periodically effect actuation of amplifier 404 and reference generator 408 and thus monitor the condition of sensor 402; to sensor supervision circuit 152 (pin 12, RB6) to effect a periodic test of sensor 150; to power supply 120 (pin 10, RB4) to selectively modify the output of converter 202 and effect battery savings; and to horn driver 140 (pin 11; RB5) and visual indicators 132 (pins 7–9, RB1–RB3) to generate appropriate status, warning and alarm signals indicative of defined CO exposure conditions (alarm or warning depending upon the concentration level and duration of exposure) and to generate defined battery or sensor failure conditions. As shown in FIG. 5, visual indicators 132 constitute respective light emitting diodes LED1, LED2 and LED3 of diverse colors (e.g., green, yellow (amber) and red, respectively).

In general, distinctive audio-visual indicia sequences are generated in response to exposure to CO at various levels for a first (warning) time period and a second, longer (alarm) time period as well as in response to the detection of low battery or failing sensor conditions. In addition, the visual indicia and/or horn are momentarily activated in response to actuation of a test/reset switch 134.

Respective distinctive warning and alarm indicia are generated in response to CO events; that is, exposure to predetermined levels of CO for predetermined periods of time. Exposure to a given level of CO for a first time period results in generation of a warning indicia while exposure for a second longer predetermined period of time results in generation of an alarm as, for example, set forth in the following Table 1:

TABLE 1

| CO LEVEL (PPM) | WARNING TIME | ALARM TIME |
|---|---|---|
| Less than 75 | No response | No response |
| 75–125 | 16 minutes | 36 minutes |
| 125–175 | 10 minutes | 20 minutes |
| 175–300 | 7 minutes | 15 minutes |
| Greater than 300 | 4 minutes | 8 minutes |

The various indicia sequences are chosen to provide an appropriate level of intrusiveness and distinctiveness (as between one another). Thus, normal operational status is indicated by periodically flashing green LED1 on a periodic basis such that, for example, LED1 would be activated for a relatively short period (such as about 10 milliseconds) about every 60 seconds.

Because a DC dangerous condition warning device relies upon battery power and an AC dangerous condition warning device typically employs a battery backup, careful consideration should be given to conserving battery energy during audio visual events. Thus, for example, in the present embodiments, audio annunciator activation (except for alarm conditions) should preferably be limited to on-times of no more than about 50 milliseconds, more preferably no more than about 20 milliseconds and most preferably about 10 milliseconds at intervals of at least about 30 seconds and preferably about one minute. Similarly, visual indicia (LEDs in the examples) employed in condition indicating modes are preferably limited to on-times no more than about 50 milliseconds, preferably no more than about 20 milliseconds and most preferably about 10 milliseconds.

Exemplary alarm indicia sequences are set forth in Table 2.

TABLE 2

| CONDITION | LED ACTUATION | HORN ACTUATION |
|---|---|---|
| Normal Standby Operation (sensing CO) | LED1 (Green) activated for a single pulse of 10 ms duration, at one minute intervals. | None |
| Battery Fault (relatively eminent battery failure) | LED1 (Green) activated in a repeating sequence of bursts of a five spaced pulses of 10 ms duration (10 ms ON, 500 ms OFF) repeated at one minute intervals. | Activated for a single pulse of 10 ms duration slightly before or substantially contemporaneous with the first LED pulse of each burst. |
| Device Fault (relatively eminent sensor degradation) | None | Activated in a repeating sequence of bursts of three 10 ms duration pulses at 500 ms intervals (10 ms ON, 500 ms OFF, 10 ms ON, 500 ms OFF, 10 ms ON) repeating at five minute intervals. |
| CO Warning Condition | LED2 (Yellow) activated in a repeating sequence of 10 ms pulses at one second intervals (10 ms ON, approximately 990 ms OFF) for the duration of the condition. | Activated in a repeating sequence of 250 ms pulses at 30 second intervals, for the duration of the condition. |
| CO Alarm Condition | LED3 (Red) activated in a repeating sequence of 10 ms pulses at 100 ms intervals (10 ms ON, approximately 90 ms OFF) for the duration of the condition. | Activated in a repeating sequence of e.g., 8 second duration pulses at 16 second intervals (8 seconds ON, 8 seconds OFF), for the duration of the condition. |

Processor 130 controls the operation of the unit by executing a predetermined sequence of steps to: appropriately test various of the system components such as sensor 150 and power supply 120; actuate amplifier 404 and reference generator 408 and sample the output of sensor 150; and direct the generation of various audible and visual indications of ambient conditions and system operation. Processor 130 also institutes specified process sequences in response to designated interrupt signals applied to the processor upon the occurrence of predetermined conditions such as the actuation of test/reset switch 134. Any suitable program for effecting such operations may be employed.

The various components of detector 100 are maintained within a housing adapted for appropriate disposition and/or mounting. In accordance with various aspects of the present invention, the housing preferably incorporates certain features, depending upon the nature of the sensor type and power source employed. For example, as will hereinafter be described in more detail, both line operated AC and DC (battery powered) units employ a test/reset switch 134 specifically configured to facilitate actuation with a pole (e.g., a broom handle) when the unit is mounted on the ceiling. Both the AC and battery powered units also provide for long term retention of protocol instructions with the unit for ongoing ready access.

Battery powered units preferably also include a battery lock out feature that precludes the device from being mounted without batteries in place. Where replaceable "button shaped" sensors, such as CO detector 402, are employed, a mechanism may be provided to prevent inadvertent reversing of the CO sensor. AC powered embodiments are preferably provided with a rotatable plug to permit the unit to be plugged into an electrical outlet at various angles relative to the axis of the outlet.

BATTERY POWERED DETECTOR

Figure 6:
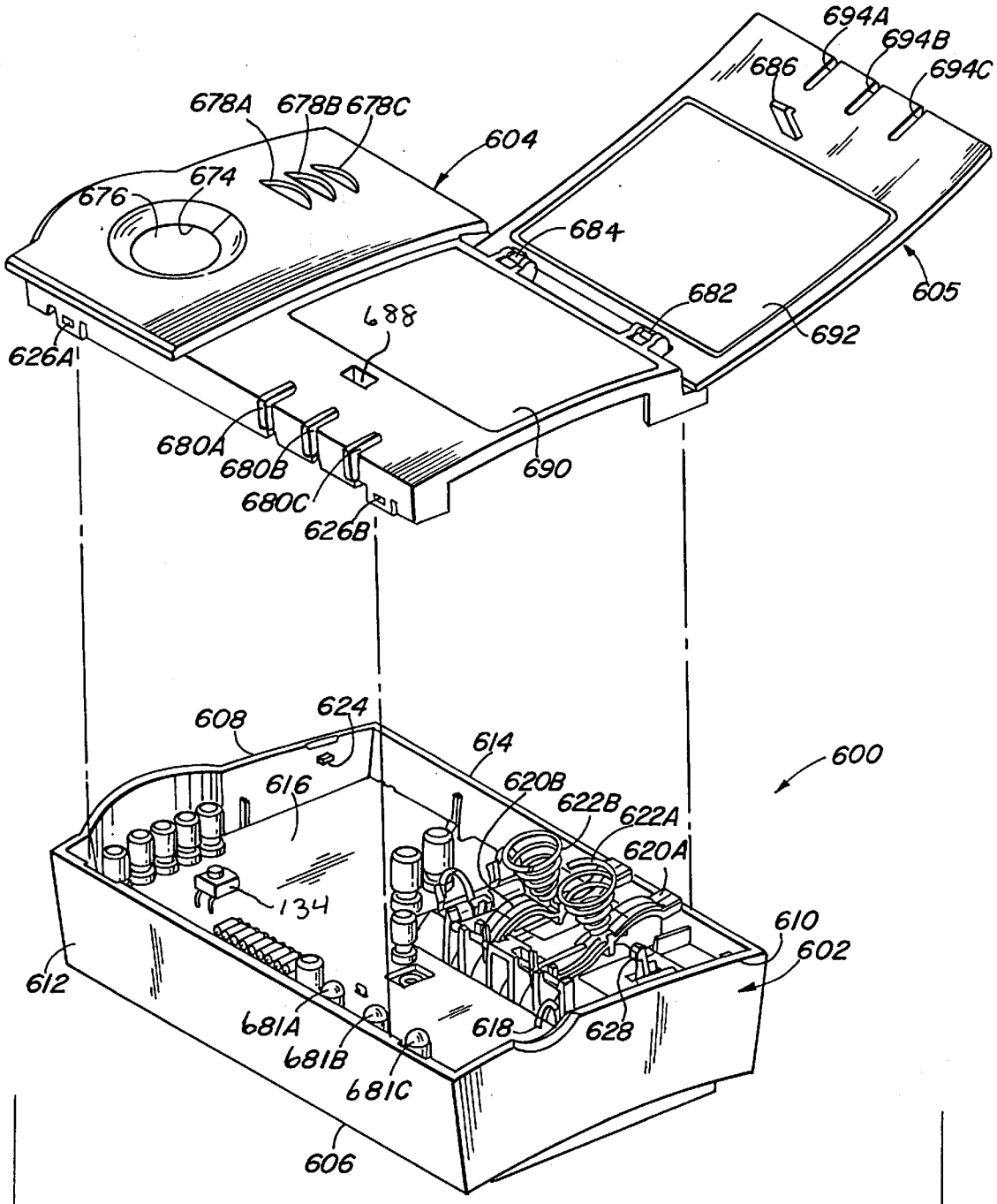
FIG. 6 is a partially exploded perspective diagram of the housing for a DC powered CO detector in accordance with various aspects of the present invention.
Figure 7A:
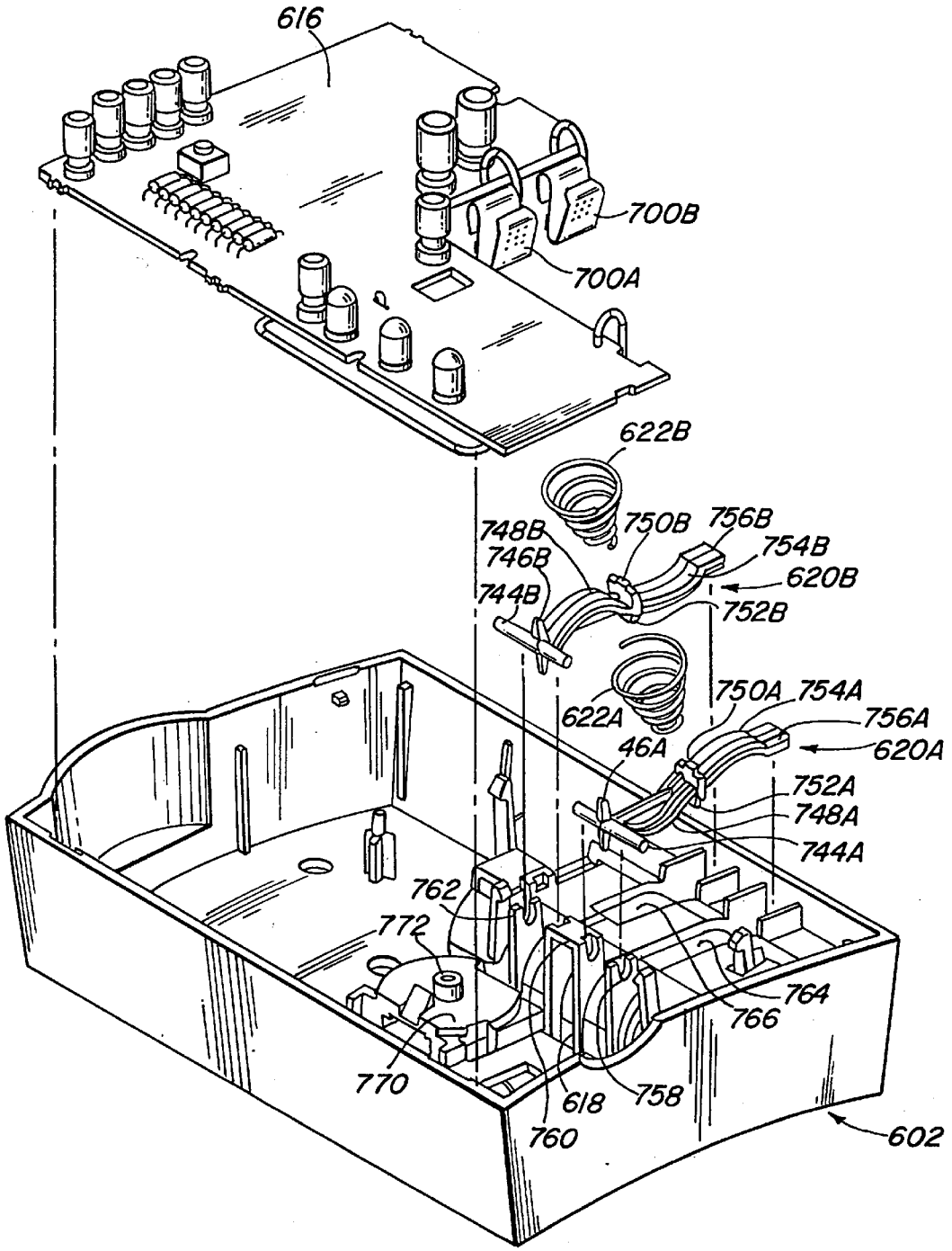
FIG. 7A is an exploded view of the base 602 shown in FIG. 6.

Referring now to FIGS. 6 and 7A, a housing 600 for a battery operated CO detector suitably includes: a base 602, a cover 604 shown in a removed position and a front door 605 pivotally mounted on cover 604. Base 602 is made of plastic material and has a generally rectangular bottom 606, end walls 608 and 610 and side walls 612 and 614.

In assembly, cover 604 is received on the open end of base 602 for a snap-together connection therewith. An extension 624 extends inwardly from wall 608 for engaging a corresponding opening (not shown) on cover 604. Two similar extensions (not shown) extend inwardly from side wall 612 to engage openings 626A and 626B in cover 604. Furthermore, a hook 628 extending from battery housing 618 engages a corresponding opening (not shown) in cover 604.

Base 602 houses: a circuit board assembly 616, a battery housing 618 molded therein, lock out pivot arms 620A and 620B pivotally attached to battery housing 618 and conical springs 622A and 622B having reduced diameter ends abutting lock out arms 620A and 620B, respectively. As best seen in FIG. 7A, circuit board assembly 616 includes battery contacts 700A and 700B for providing contact with a battery power source (not shown).

Lock out pivot arms 620A and 620B (collectively referred to as arms 620) are employed as battery presence sensing members to prevent detector unit 600 from being mounted without batteries. Lock out arms 620 are substantially identical, each generally "S" shaped and having a pivot member 744, a stabilizer 746, an arcuate section 748, projections 750 and 752, an arcuate section 754 and an end portion 756. Lock out arms 620 are pivotally mounted within the battery housing 618. Respective pivot support members 758, 760 and 762, each including arched recesses, are provided for receiving pivot members 744 of lock out arms 620. Lock out arm 620A is pivotally mounted on support members 758 and 760, and lock out arm 620B is pivotally mounted on support members 760 and 762. Elongated horizontal slot 764 is provided in battery housing 618 and is disposed and appropriately shaped and sized to receive arcuate section 748A, projection 750A and arcuate section 754A of lock out arm 620A. Similarly, horizontal slot 766 is disposed and appropriately shaped and sized to receive arcuate section 754B, projection 752B and arcuate section 754B of lock out arm 620B.

Figure 10A:
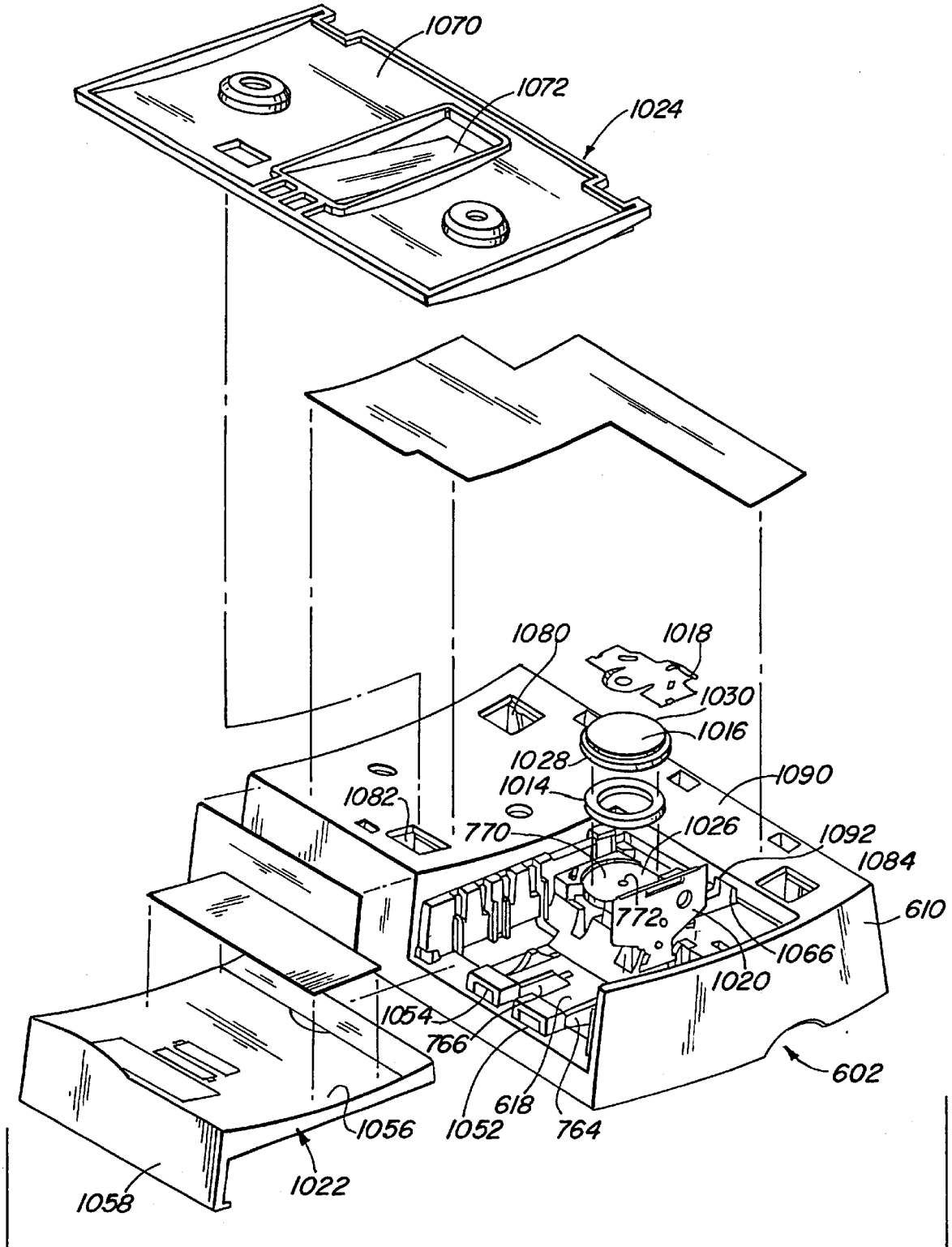
FIG. 10A is an exploded perspective view of the mounting side of the base of the unit of FIG. 6 illustrating a replaceable CO sensor unit.

Still referring to FIG. 7A and also to the inverted view of FIG. 10A, base 602 further encloses a cylindrical sensor housing 770 incorporating a circular vertical capillary 772 for maintaining diffusion of gas molecules therethrough to a sensor 1016 mounted in the sensor housing 770 relatively constant to detect the presence of carbon monoxide. Thus, it will be seen that the aperture of the capillary 772 extends from the upper side of the base 602 (FIG. 7), to a region immediately above the sensor 1016 (best seen in the inverted view of FIG. 10A) which is contained within the sensor housing 770 (disposed on the lower side of the base 602) such that the ambient air is fed directly to the sensor substantially only through the capillary 772 at a controlled rate. The provision of the capillary results in more consistent and meaningful readings from sample to sample and also limits the disruptive effects of transient, but contextually unimportant, CO concentration spikes such as might be encountered if an internal combustion engine or other CO source is briefly brought near the detector. Preferably, the base 602 and the sensor housing 770 constitute a unitary molded plastic structure.

Figure 9:
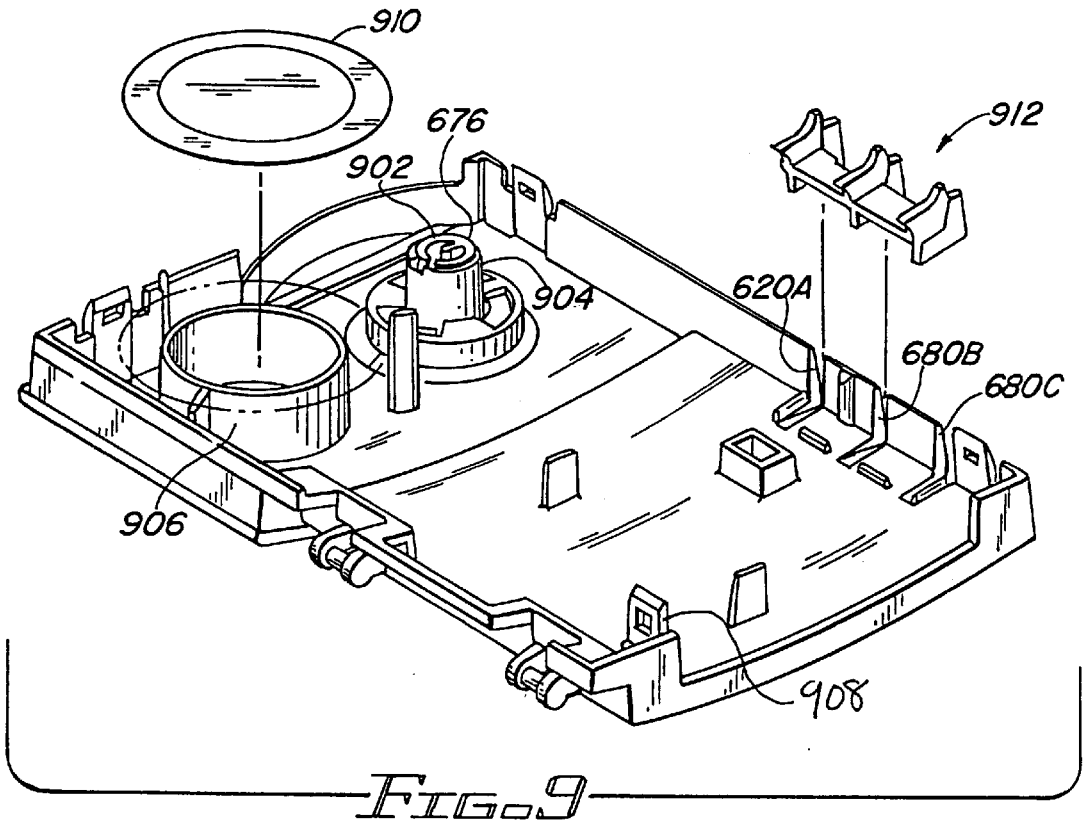
FIG. 9 is an exploded perspective of the interior side of the cover of the unit of FIG. 6.

Referring again to FIG. 6, the front of cover 604 includes a round recess 674 for receiving a button 676, precision apertures 678A, 678B and 678C for facilitating the broadcasting of an alarm sound and vertical slots 680A, 680B and 680C for receiving a light pipe (912; FIG. 9). The light pipe transmits to the front of cover 604 the light signals from circuit board assembly 616 and, more particularly, from light indicators 681A, 681B and 681C that indicate whether the detector is on or off, whether the level of carbon monoxide in the area being monitored is increasing or whether the level is high, respectively.

Front door 605 is pivotally mounted on cover 604 by pivot assemblies 682 and 684. In the closed position, door 605 locks on cover 604 via a hook 686 which engages opening 688. Instruction labels (not shown) are placed on label surfaces 690 and 692 of cover 604 and door 605, respectively, with appropriate instructions and protocol regarding, among other things, the status of the detector, the replacement of the battery or the sensor and steps to be taken when the alarm activates. Door 605 further includes slots 694A, 694B and 694C which are aligned with slot 680A, 680B and 680C when door 605 is closed.

Figure 7B:
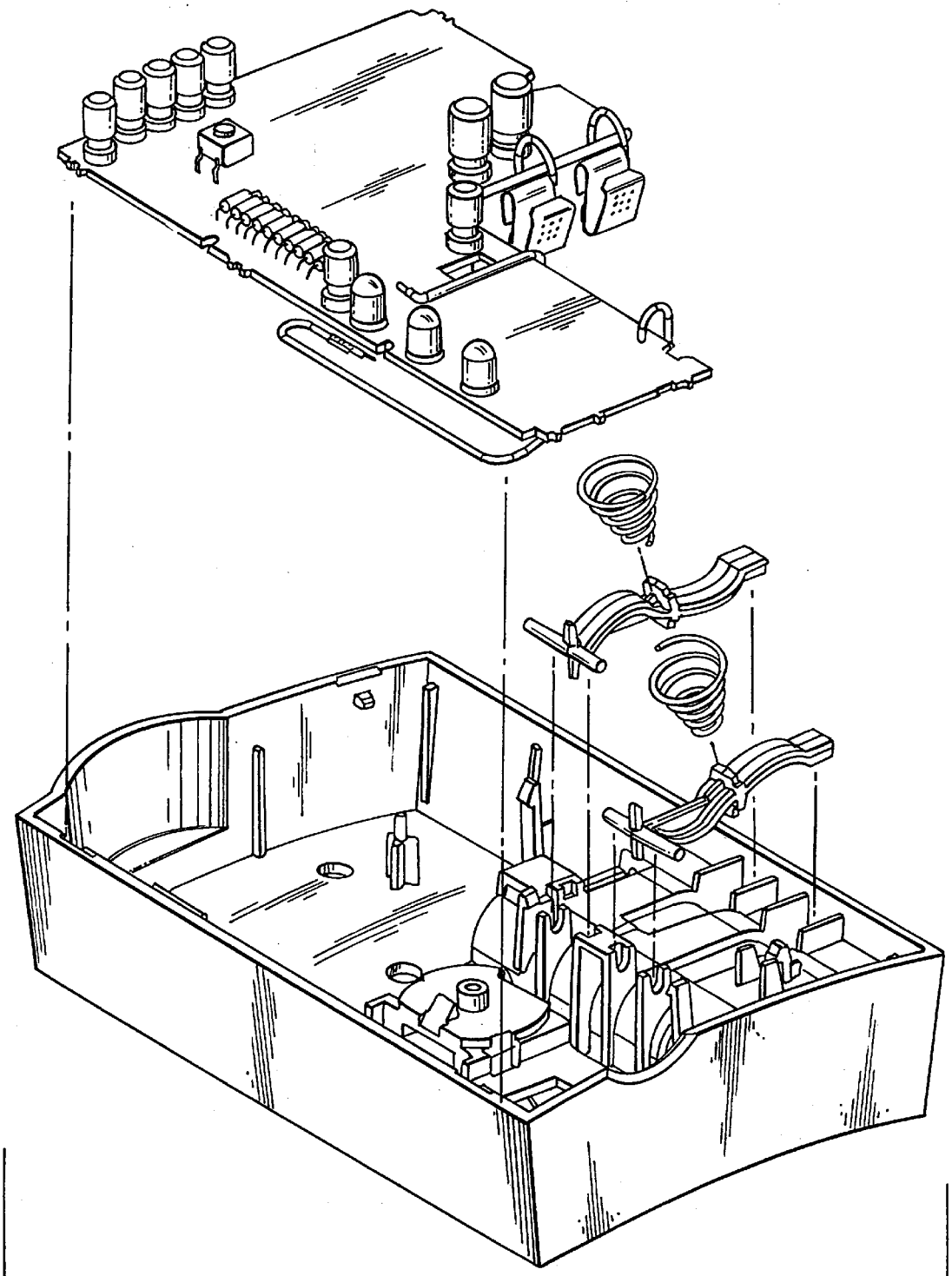
FIG. 7B is an exploded view of the base 602 shown in FIG. 6 in a slightly revised configuration adapted to accommodate a non-replaceable CO sensor unit.

FIG. 7B illustrates a slightly revised configuration of the base 602 adapted to accommodate a non-replaceable CO sensor unit. In this version of the base 602, a wire 771 has been added to the printed circuit board 616 to couple to the non-replaceable CO sensor unit to be discussed below in conjunction with FIG. 10B.

Figure 8:
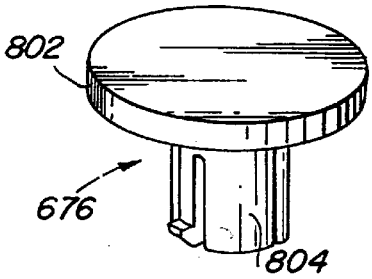
FIG. 8 is a perspective view of a test/reset button.

Referring to FIG. 8, button 676 includes a head 802 and a reduced diameter portion 804. Head 802 is sufficiently large to facilitate activation of button 676 by a broom stick or the like in order that the button 676 of a ceiling (or other remotely) mounted unit can be readily actuated without the need to employ a ladder or other expedient to reach the unit. As will be discussed below, pressing button 676 actuates test/reset switch 134.

Attention is now directed to FIG. 9 in which it will be seen that the back (interior) side of cover 604 includes a cylindrical extension 904, a rim 906, and an aperture 908. With reference to FIGS. 6–9, aperture 908 engages hook 628 (FIG. 6) when the cover is attached to base 602 and slots 680A, 680B and 680C. Cylindrical extension 904 is appropriately sized to receive reduced diameter portion 804 of button 676, so that button 676 can activate switch 134 on circuit board assembly 616 (shown in FIGS. 6 and 7) when detector 600 is in service. The bottom of rim 906 includes apertures 678A, 678B and 678C (shown in FIG. 6). A horn 910, shown prior to assembly with cover 604, securely rests on the mouth of rim 906 and to contact circuit board assembly 616 (shown in FIGS. 6 and 7) so that it can be activated therefrom and to broadcast the alarm. A light pipe 912, also shown prior to assembly, is constructed of clear polystyrene material and is configured for insertion into slots 680A, 680B and 680C.

Figure 12:
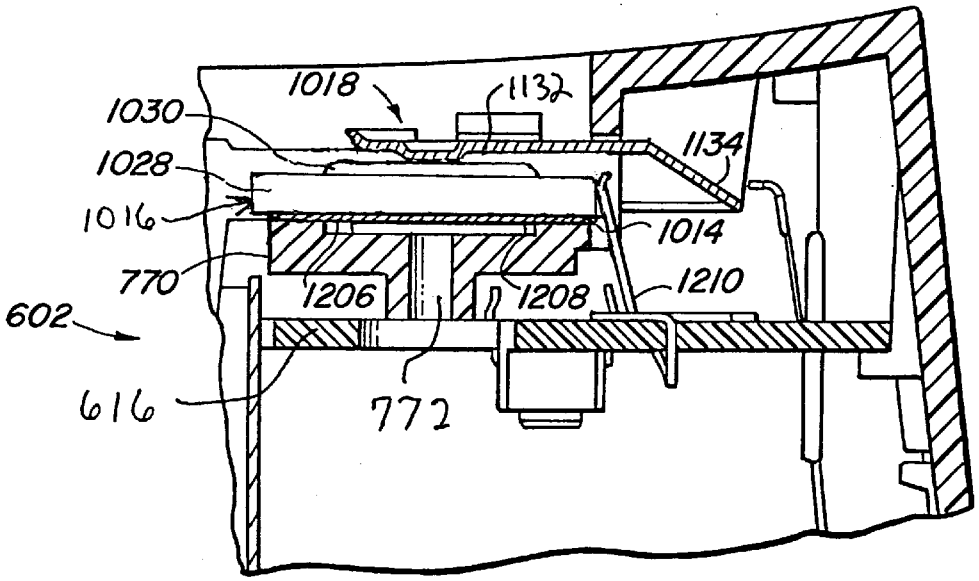
FIG. 12 is a partial cross section of the base of the embodiment of FIG. 6 showing a button type sensor in place.

Referring now to FIGS. 10A and 12, CO sensor 1016 is generally cylindrical and is secured underlying correspondingly generally cylindrical sensor housing or receptacle 770 and disposed to receive gas molecules diffusing through capillary 772. Receptacle 770 is dimensioned to closely receive sensor 1016 into its open upper end. Sensor 1016 is, in this embodiment, preferably a generally flat round element (e.g. button shaped) with an anode 1030 and cathode 1028. Cathode 1028 preferably is of increased diameter, corresponding to the outer periphery of the sensor 1016, relative to anode 1030 and constitutes both the electrically conductive lower portion and outer periphery of the sensor. Anode 1030, electrically insulated from cathode 1028, is disposed within the sidewalls of cathode 1028, forming the top of the sensor cell.

Figure 11:
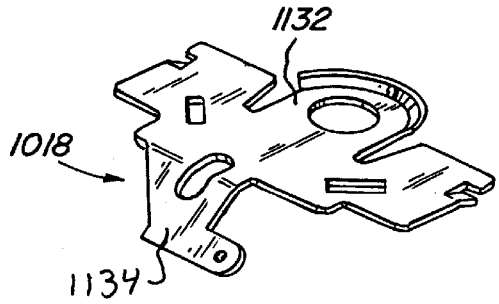
FIG. 11 is a perspective view of a top sensor contact employed in the embodiment of FIG. 6.

As best seen in FIGS. 10A and 12, sensor housing 770 includes a recess 1026, suitably concentric about the mouth of capillary 772, which is generally configured in accordance with sensor 1016, e.g., is substantially round for receiving a resilient gasket 1014. A sensor contact mechanism is employed to secure sensor 1016 in place and to prevent inadvertent reversal of sensor 1016 during mounting. Referring now to FIGS. 10A and 11–13, electrical contact to sensor 1016 is effected by top and side contacts 1018 and 1210. As best seen in FIG. 11, top sensor contact 1018 includes a substantially flat portion 1132 and a side extension 1134, forming an angle therewith.

When assembled, flat portion 1132 is slidingly inserted into and retained within respective slots on opposite walls of sensor housing 770. Sensor 1016 is received under flat portion 1132 of the top contact. Once the sensor is inserted in place and correctly positioned, flat portion 1132 abuts the top end of sensor 1016 and biases sensor 1016 against gasket 1014 to form a seal therebetween and a chamber defined by the lower surface of sensor 1016, gasket 1014 and surface 1026.

According to the present embodiment of the invention, the upper, decreased diameter portion 1030 of sensor 1016 constitutes an anode and the lower, increased diameter portion 1028 constitutes a cathode. In the correctly assembled position, contact 1018 is in contact with sensor anode 1030, and side extension 1134 is connected to a wire (not shown) that connects to the positive side of circuit board assembly 616. Furthermore, in the correctly assembled position, side sensor contact 1210 is mounted on the circuit board assembly 616 to abut lower increased diameter portion 1028 (cathode) of the sensor 1016. In that position, the side sensor contact is also in electrical contact with the negative side of the circuit board assembly 616, thereby providing electrical contact between increased diameter portion 1028 and circuit board assembly 616.

Figure 13:
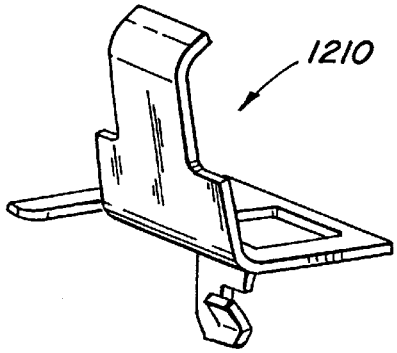
FIG. 13 is a perspective view of a side sensor contact employed in the embodiment of FIG. 6.

Referring particularly now to FIG. 12, there is shown a partial cross section of base 602 illustrating sensor housing 770 having surface 1206 and capillary 772 extending therethrough, gasket 1014 and sensor 1016 being biased against gasket 1014 by top sensor contact 1018 and forming a chamber 1208 therebetween with surface 1206 and gasket 1014. Increased diameter portion 1028 abuts a side sensor contact 1210 which is electrically connected to the negative side of circuit board assembly 616 and decreased diameter portion 1030 abuts top sensor contact 1018 which is electrically connected to the positive side of circuit board assembly 616. A perspective view of side sensor contact 1210 is shown in FIG. 13.

It should be noted that, because of the design of sensor 1016 and the positioning of top sensor contact 1018 and side sensor contact 1210, if sensor 1016 is positioned in sensor housing 770 upside down, side sensor contact 1210 will still connect with increased diameter portion 1028, and top sensor contact 1018 will also connect with increased diameter portion 1028 via the electrically conductive lower portion, but the decreased diameter portion 1030 will not be floating. Thus, the increased diameter portion 1028 will cause the contacts 1018 and 1210 to be at the same potential; i.e., will short them out. Circuit board assembly 616 will detect that condition and issue an alarm to notify the user of the faulty installation.

Figure 14:
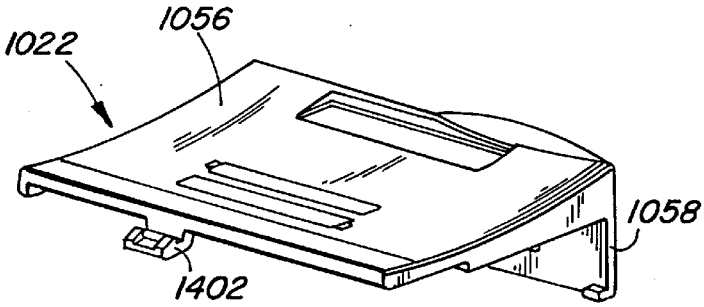
FIG. 14 is a perspective view of a battery door employed in the embodiment of FIG. 6.
Figure 15:
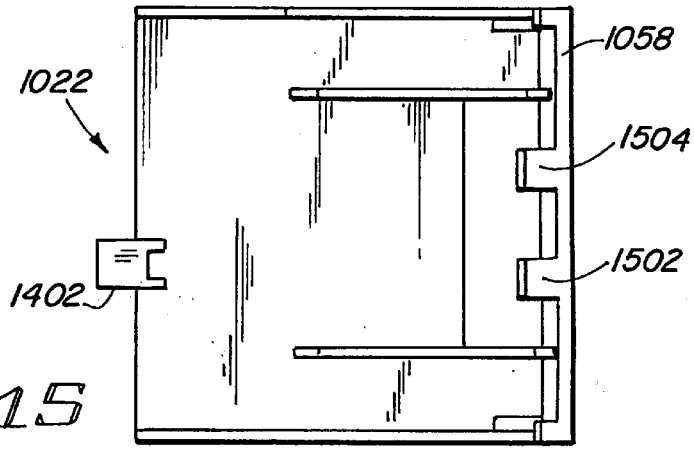
FIG. 15 is a bottom view of the battery door shown in FIG. 14.

Referring again to FIG. 10A with reference also to FIGS. 6 and 7A, battery housing 618 is configured to house two generally cylindrical batteries (not shown in FIG. 10A) and battery contact 1020 which is slidingly inserted into an appropriate slot (not shown in FIG. 10A) in the interior of end wall 610 to provide contact between the two batteries. The bottom of battery housing 618 is open to slots 764 and 766, previously described. Base 602 further includes interlock openings 1052 and 1054 which are aligned with slots 764 and 766, respectively. Battery housing cover or door 1022 includes a base 1056 and a substantially vertical wall 1058 extending from one end of base 1056. Referring also to FIG. 14, battery door 1022 has a hook 1402 extending from base 1056. As shown in FIG. 15, battery door 1022 also has projecting members 1502 and 1504 inwardly extending from wall 1058.

Referring to FIGS. 10A, 14 and 15, in order to fully close the back of base 602 with battery door 1022, hook 1402 must be snappingly received in opening 1066 and projecting tab members 1502 and 1504 must be fully received in openings 1052 and 1054, respectively. If there is an obstruction in opening 1052 or 1054, battery door 1022 will not fully close. According to the present invention, appropriate apparatus is provided, as described hereinafter, to prevent battery door 1022 from closing if both batteries are not placed in battery housing 618.

Figure 16:
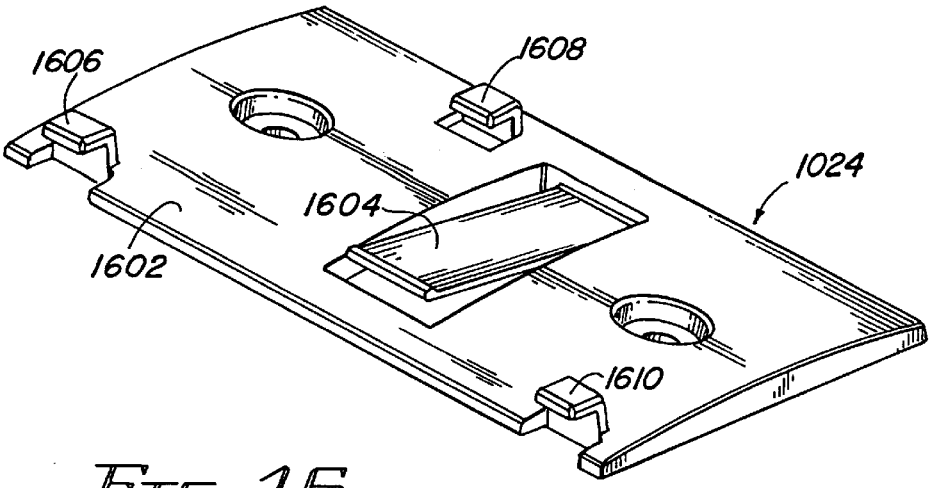
FIG. 16 is a perspective view of the mounting bracket of the embodiment of FIG. 6.

Referring now to FIGS. 10A and 16, mounting bracket 1024 includes a generally flat section 1602, a spring member 1604 and hooks 1606, 1608 and 1610 which are respectively receivable in openings 1080, 1082, 1084 on base 602. Bracket 1024 is suitably designed so that bracket 1024 will not fully engage base 602 if battery door 1022 is not fully closed and thus functions as a lockout member. More particularly, if battery door 1022 is not fully closed so that it is substantially even with upper surface 1090 of base 602, spring member 1604 abuts wall 1092 and prevents bracket 1024 from fully engaging base 602. If battery door 1022 is fully closed, battery door 1022 sufficiently biases spring member 1604 to enable it to advance past wall 1092, thereby allowing bracket 1024 to fully engage base 602.

Referring to FIGS. 6, 7A, 10A and 15, when cover 604 is received on the open end of base 602 for a snapping connection therewith, it causes conical springs 622A and 622B to compress against and to push lock out arms 620A and 620B into slots 764 and 766, respectively. If there are no batteries in battery housing 618, conical springs 622A and 622B bias lock out arms 620A and 620B to positions at which ends 756A and 756B obstruct openings 1052 and 1054 to prevent battery door 1022 from fully closing. If either battery is missing, one of the two lockout arms 620A and 620B will continue to obstruct one of the two openings 1052 and 1054, thereby preventing the full closure of battery door 1022. If both batteries are in place, the batteries abut portions 748A and 748B and prevent ends 756A and 756B from obstructing openings 1052 and 1054.

Figure 10B:
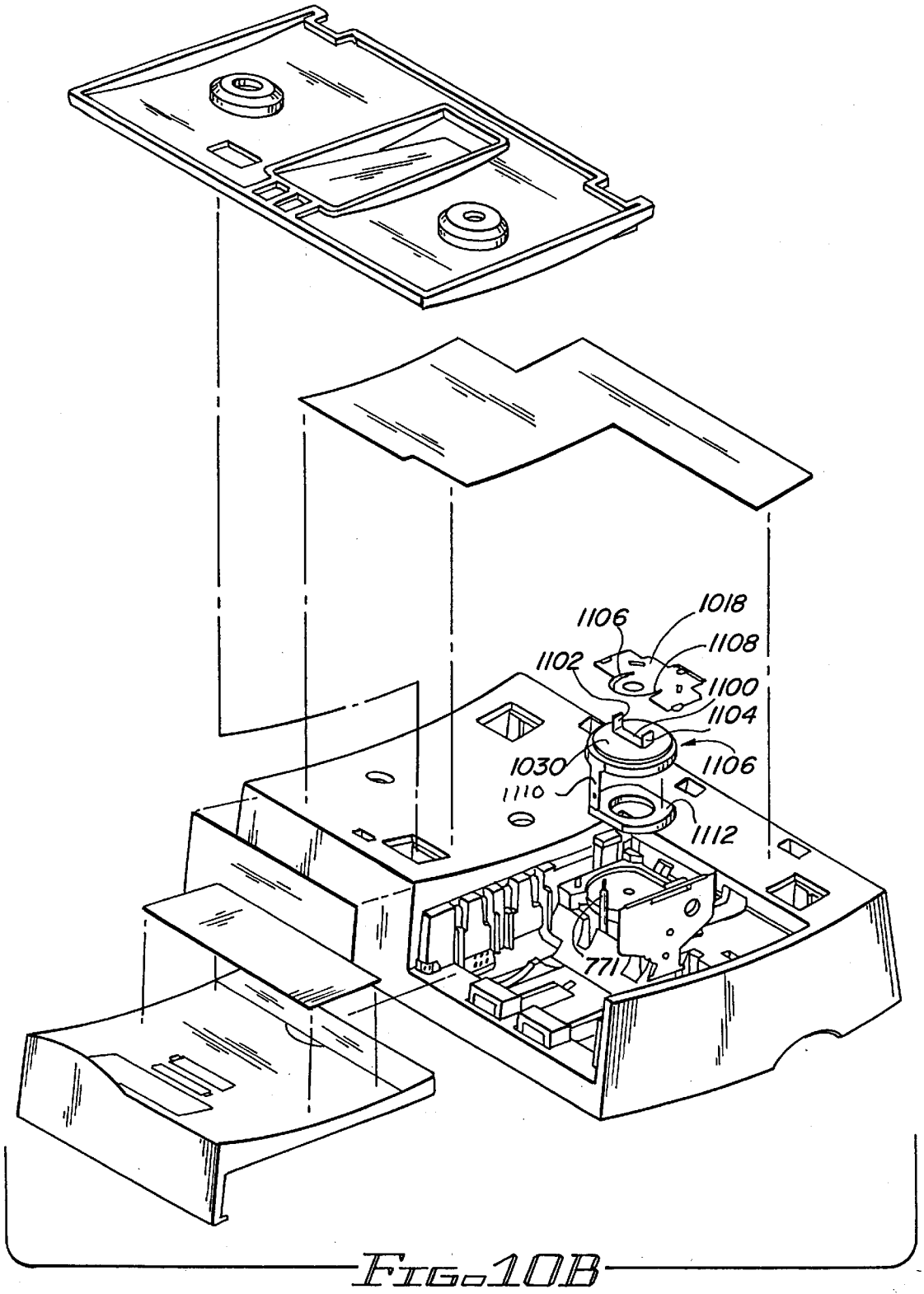
FIG. 10B is an exploded perspective view of the mounting side of the base of the unit of FIG. 6, alternatively illustrating a non-replaceable CO sensor unit.

Referring to FIGS. 7B and 10B, an alternative embodiment is shown which differs from that shown in FIGS. 7A and 10A only in that a permanently mounted (rather than replaceable) sensor unit 1016 is employed. Experience has shown that the type of sensor unit 1016 used in the presently preferred configuration is sufficiently reliable in long term use that providing for user or field replacement is not necessary for many applications, particularly for home use. Thus, a bracket 1100 is affixed, as by spot welding, to the anode 1030 and in electrical contact therewith. The bracket 1100 has upturned ends 1102, 1104, configured such that, when assembled, the respectively extend into corresponding slots 1106, 1108 in the top contact 1018. Once the sensor 1016 has been emplaced during fabrication, the upturned ends 1102, 1104, extending through the angled slots 1106, 1108, are soldered to the upper contact 1018 to effect the permanent installation. The wire 771 (see also FIG. 7B) is soldered to a tab 1110 which is fixed to the cathode 1028 of the sensor 1016. Gasket 1112 may have a slightly different configuration than gasket 1014 shown in FIG. 10A in order to clear tab 1110.

Following proper installation as described above, detector 600 will monitor the environment for CO in the following manner. Gas from the ambient environment enters the interior of detector 600. Capillary 772 provides a steady rate of flow of gas into chamber 1208. If the gas entering chamber 1208 contains CO, sensor 1016 converts the CO to $CO_2$ as previously described. If a sufficient amount of CO is sensed and, correspondingly, $CO_2$ is formed, sensor 1016 will cause circuit assembly 616 to trigger an alarm that signals the presence of a high level of CO.

DETECTOR WITH LINE-OPERATED POWER SUPPLY

Figure 17:
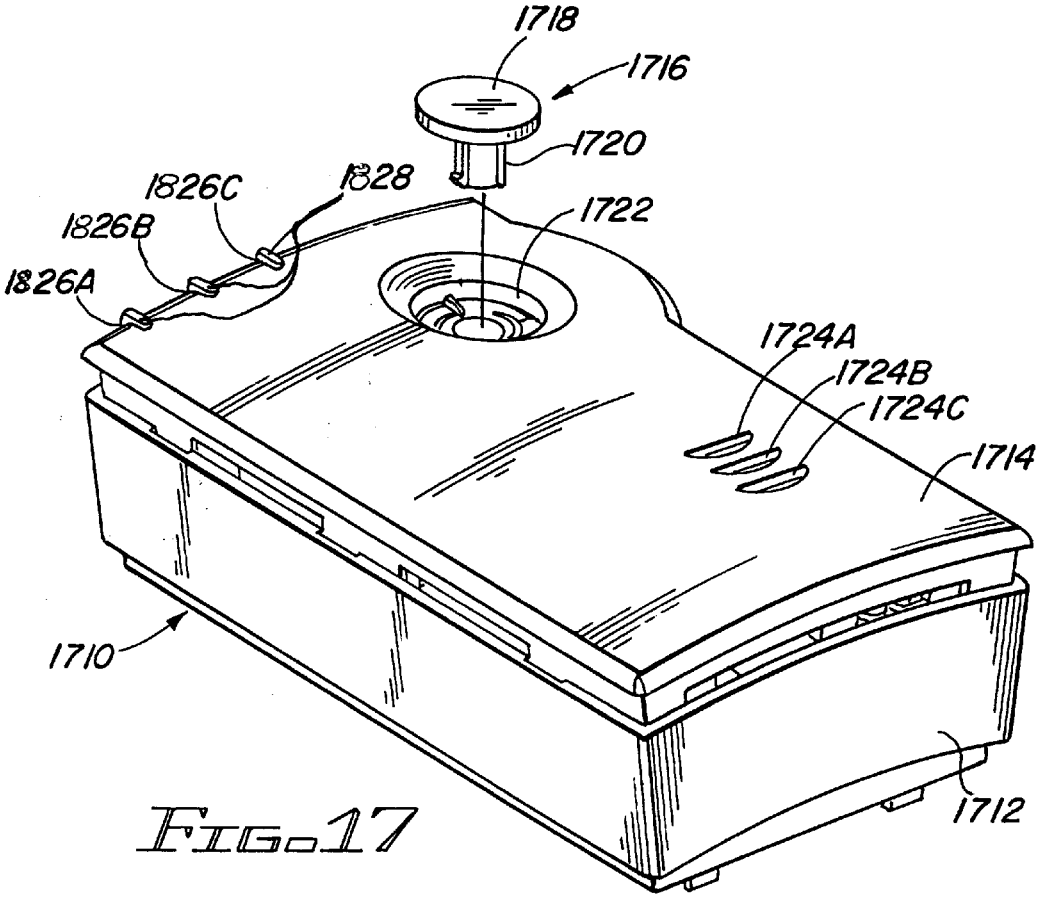
FIG. 17 is a partially exploded view of an AC line current operated CO detector embodiment in accordance with various aspects of the present invention.

Referring now to FIG. 17, there is shown an AC line-operated CO detector 1710 having a base 1712, a cover 1714 connected to the base and a button 1716, illustrated in a removed position. Button 1716 has a head 1718 and a reduced diameter portion 1720. Head 1718 is sufficiently large to allow the activation of button 1716 by a broom stick or the like. Cover 1714 has a round recess 1722 for receiving button 1716; apertures 1724A, 1724B and 1724C for facilitating the broadcasting of an alarm sound; and vertical slots 1826A, 1826B and 1826C for receiving a light pipe unit 1828.

Figure 18:
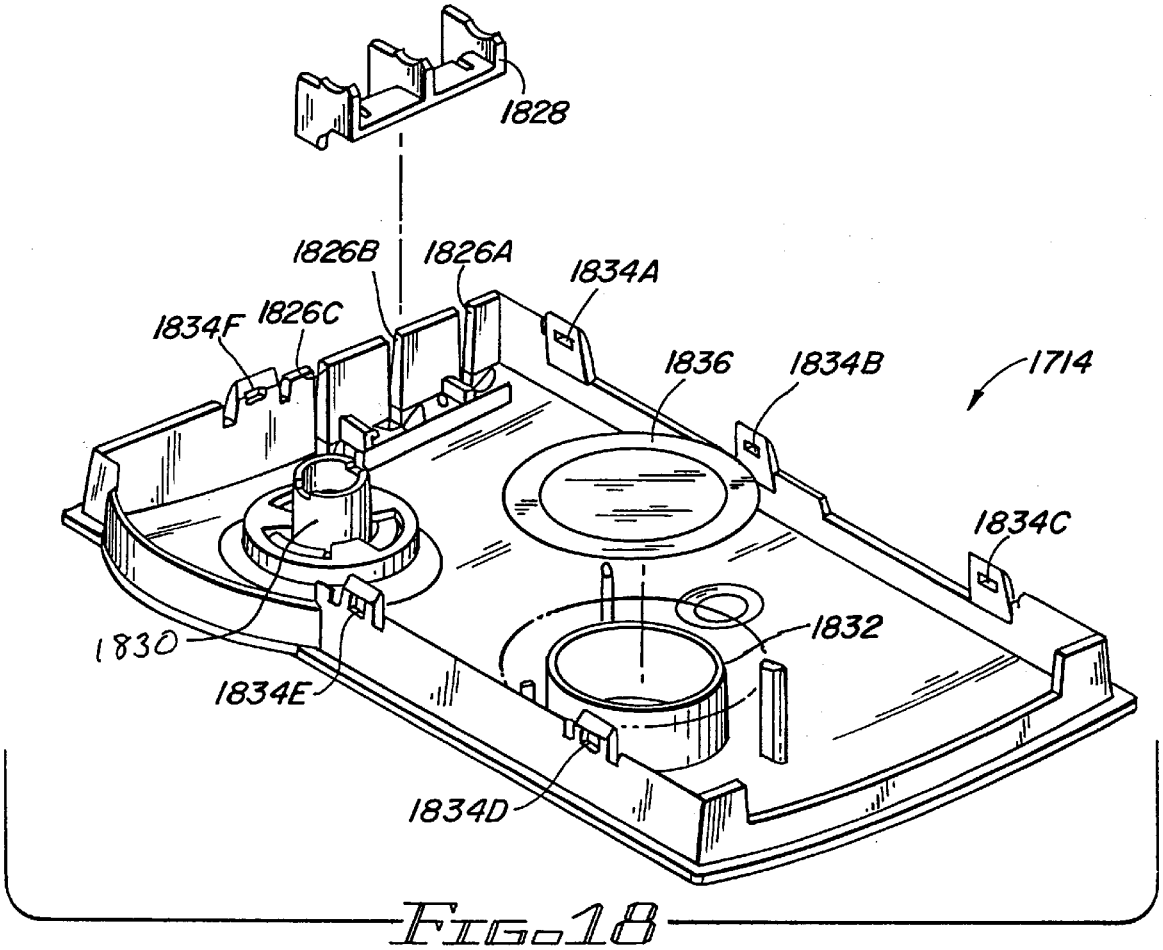
FIG. 18 is a perspective view of the inside of the cover of the embodiment of FIG. 17.

Referring now to FIG. 18, there is shown the back or interior side of cover 1714 having a cylindrical extension 1830; a rim 1832; apertures 1834A, 1834B, 1834C, 1834D, 1834E and 1834F for engaging snapping hooks (not shown in FIG. 18) when cover 1714 is attached to base 1712; and slots 1826A, 1826B and 1826C. Cylindrical extension 1830 is appropriately sized to receive reduced diameter portion 1720 so that button 1716 can activate a circuit board assembly (not shown in FIG. 18) when detector 1710 (FIG. 17) is in service.

The bottom of rim 1832 includes apertures 1724A, 1724B and 1724C (FIG. 17). A horn 1836, shown prior to assembly with cover 1714, is suitably dimensioned to securely rest on the mouth of rim 1832 and to contact a circuit board assembly (not shown in FIG. 18) so that it can be activated therefrom to broadcast an alarm. Lightpipe unit 1828, also shown prior to assembly, is constructed of crystal clear polystyrene material and is configured for insertion into slots 1826A, 1826B and 1826C.

Figure 19:
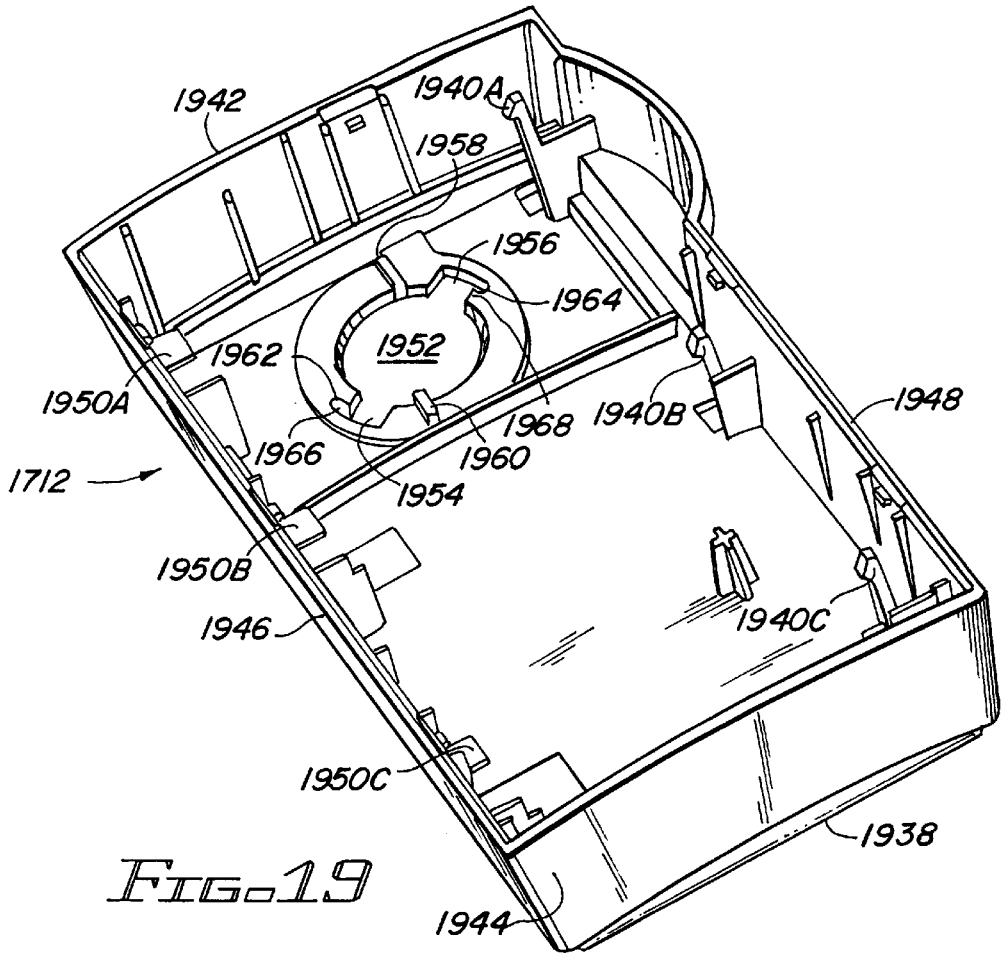
FIG. 19 is a perspective view of the interior of the base of the embodiment of FIG. 17.

Referring now to FIG. 19, base 1712 is made of plastic material and has a generally rectangular bottom 1938; hooks 1940A, 1940B and 1940C extending from bottom 1938; end walls 1942 and 1944; side walls 1946 and 1948 and extensions 1950A, 1950B and 1950C projecting inwardly from side wall 1946. Base 1712 has a circular opening 1952 with diametrically opposite radial slots 1954 and 1956. Diametrically opposite stop elements 1958 and 1960 and diametrically opposite pegs 1962 and 1964 extend from the inner surface of bottom 1938 adjacent circular opening 1952. Peg 1962 has a tapered side 1966 facing slot 1954, and peg 1964 has a tapered side 1968 facing slot 1956.

Figure 20:
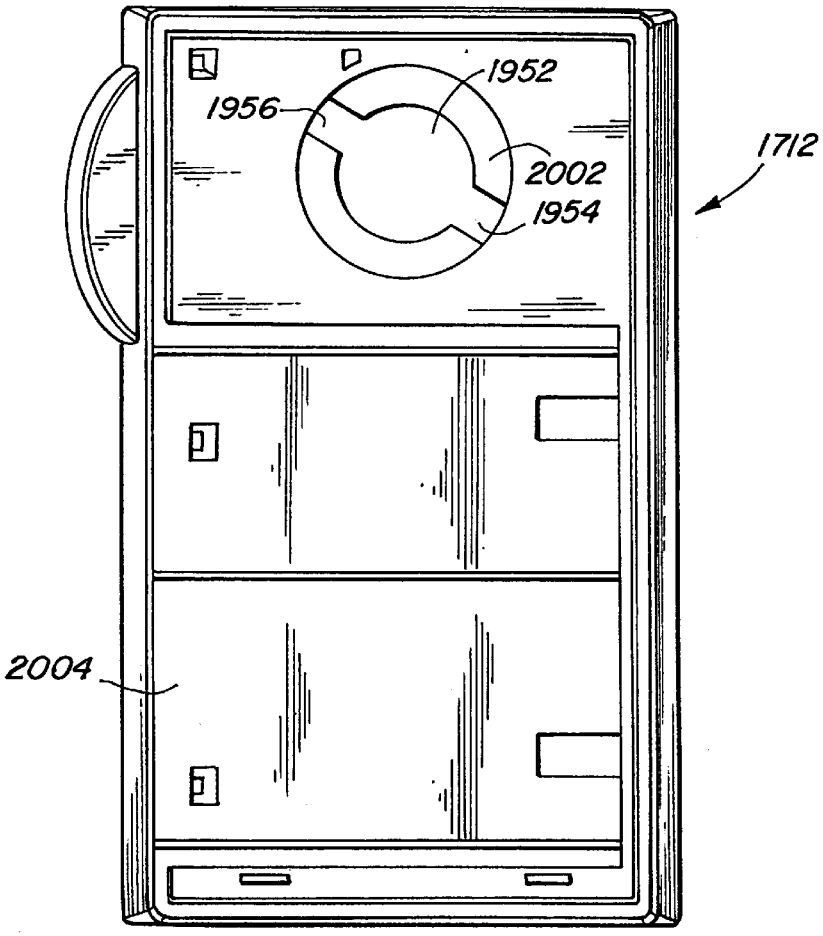
FIG. 20 is a bottom view of the base of the embodiment of FIG. 17.
Figure 23:
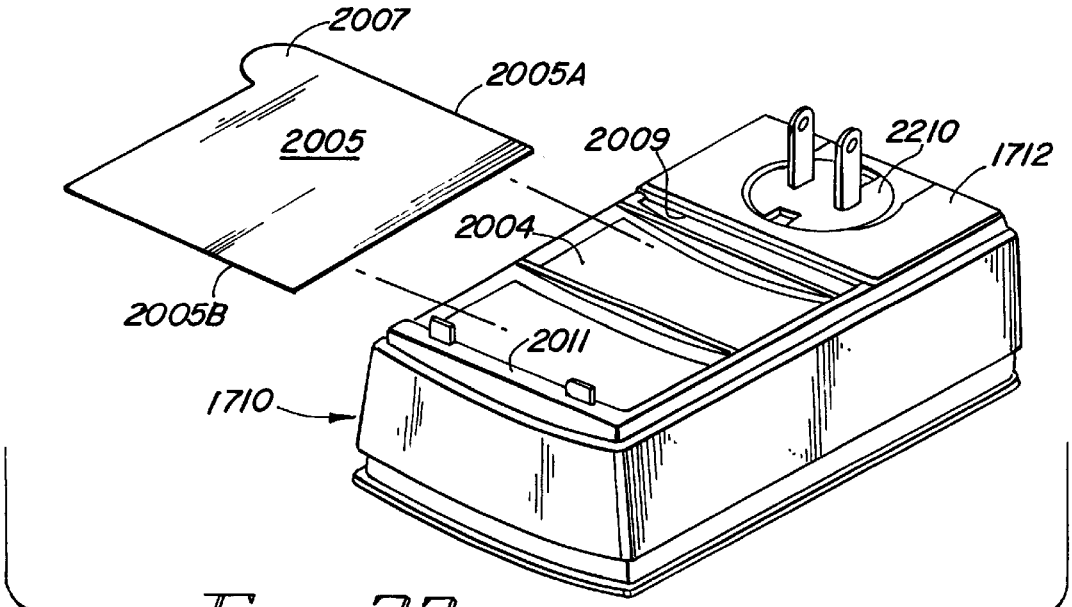
FIG. 23 is a bottom perspective view of the base of the embodiment of FIG. 17 shown with the plug of FIG. 22 attached thereon.

Referring now to FIGS. 20 and 23, there is shown a bottom view of base 1712 with opening 1952, radial slots 1954 and 1956 and a segmented circular recess 2002. The radial slots 1954 and 1956 extend outwardly beyond the maximum dimension (diameter in the example) of the opening 1952.

Rear facing base 1712 includes a label area 2004 for slidingly attaching a removable warning and alarm card 2005 carrying printed instructions and protocol information. In order to insure long term retention of the instruction and protocol information, alarm card 2005 should be durable and resilient. It may, for example, be fabricated from a relatively stiff plastic sheet or a relatively stiff paper sheet, preferably coated with a clear plastic material to preserve the printed information.

In normal use, the card 2005 is normally slidingly engaged to the base 1712 by feeding first and second generally parallel card side edges 2005A, 2005B respectively into slot 2009 and a corresponding slot (out of view in FIG. 23) behind bottom end region 2011 of base 1712, the slots being generally parallel, mutually facing and suitably spaced to retain the card. Thus, when the detector is attached to a supporting surface by, for example, plugging it into a socket, the instruction and protocol is safely stored for long term reference. If it becomes necessary to refer to the instructions and protocol information, the detector may be unplugged or otherwise detached from the supporting surface and the card 2005 slidingly removed using tab 2007 to facilitate pulling the card from the base. The card 2005 may be replaced after the purpose for its access has been achieved such that its long term preservation with the detector is maintained.

Figure 21:
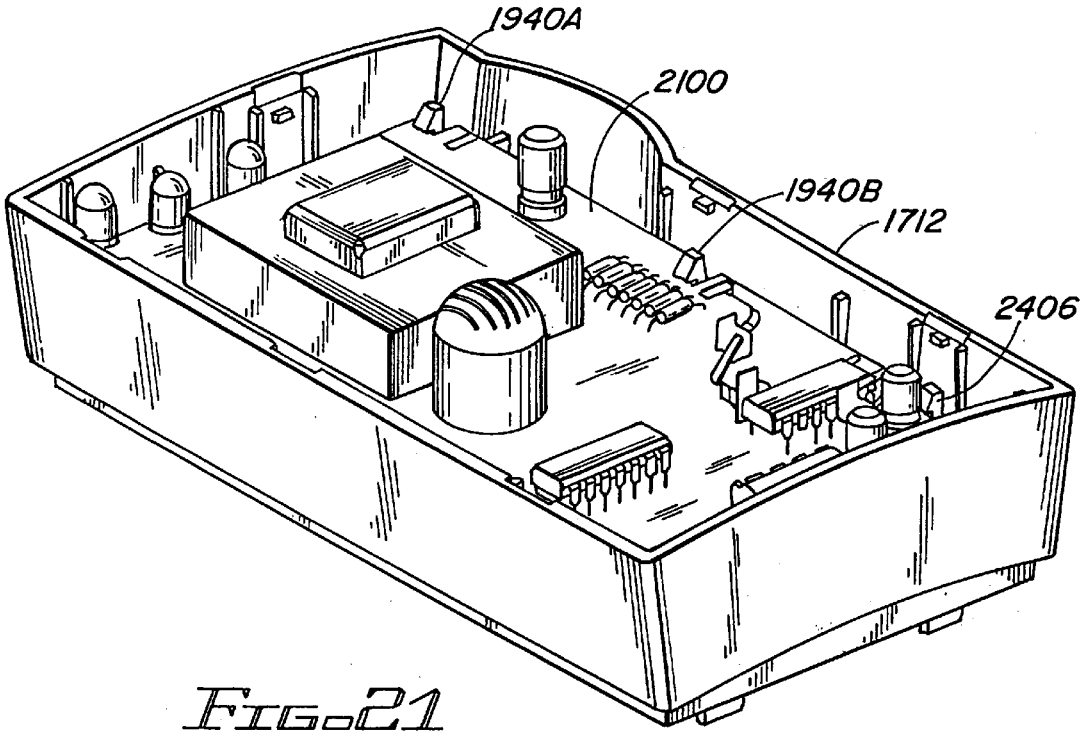
FIG. 21 is a perspective view of the interior of the base of the embodiment of FIG. 17 shown with a circuit board installed.

As shown in FIGS. 19 and 21, a circuit board assembly 2100 is inserted into base 1712 and is securely retained therein by hooks 1940A, 1940B and 1940C and extensions 1950A, 1950B and 1950C. Assembly 2100 includes appropriate detector and alarm apparatus to detect the presence of a high amount of CO and to trigger an alarm to alert people of the consequent danger.

Figure 22:
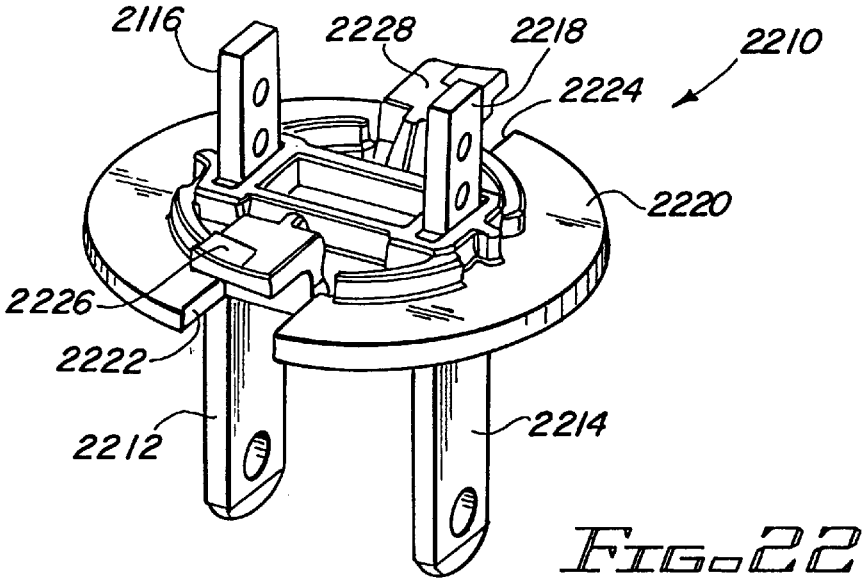
FIG. 22 is a perspective view of a plug for rotatably mounting the embodiment of FIG. 17 to an electrical socket.

One of the novel features of the present invention is the use of a rotatable plug to connect detector 1710 to an electrical socket. Referring to FIG. 22, there is shown a plug 2210 having prongs 2212 and 2214 with corresponding terminals 2216 and 2218 for coupling an AC line to the internal power supply. Plug 2210 has a segmented flange 2220 with diametrically opposite radial slots 2222 and 2224 and diametrically opposite radial extensions 2226 and 2228 which are disposed axially offset from and immediately above slots 2222 and 2224, respectively.

Referring now to FIGS. 19, 20, 22 and 23, the plug 2210 is coupled to the base 1712 by aligning radial extensions 2226 and 2228 with slots 1954 and 1956 and inserting the plug 2210 into the opening 1952 until the segmented flange 2220 abuts the circular recess 2002.

Then, the plug 2210 is rotated to cause the radial extensions 2226 and 2228 to ride up the tapered sides 1966 and 1968 of the slots 1954 and 1956 until the radial extensions clear the pegs 1962 and 1964. The plug is then permanently captured by the base 1712. However, the plug and base are mutually rotatable between 90° spaced positions, limited by the interaction of the radial extensions 2226 and 2228 bearing against the stops 1958 and 1960 at one extreme and against the pegs 1962 and 1964 at the other extreme. Consequently, the dangerous condition warning device can be oriented, with respect to a wall socket, vertically, horizontally or at any angle between.

It will be understood that while various of the conductors and connections are shown in the drawing as single lines, they are not so shown in a limiting sense, and may comprise plural conductors or connections as understood in the art. Similarly, power connections, various control lines and the like, to the various elements are omitted from the drawing for the sake of clarity. Further, the above description is of preferred exemplary embodiments of the present invention, and the invention is not limited to the specific forms shown. Modifications may be made in the design and arrangement of the elements within the scope of the invention, as expressed in the claims.

What is claimed is:

1. In a dangerous condition warning device adapted to issue an alarm when a sensed dangerous condition exceeds a predetermined status, which dangerous condition warning device has associated therewith protocol and instruction information which are intended to be permanently linked with said dangerous condition warning device for future reference, means for retaining said protocol and instruction information with said dangerous condition warning device comprising:

A) a card having instruction and protocol information printed thereon, said card having first and second generally parallel side edges; and B) a housing for said dangerous condition warning device, said housing being detachably attachable to a supporting surface for operational mounting, said housing including:

1) a base member having an outside surface including a rear facing portion disposed adjacent the supporting surface when said dangerous condition warning device is installed for normal operation, said rear facing portion carries an AC plug such that said housing is detachably attachable to said supporting surface by plugging said AC plug into a corresponding socket disposed on said supporting surface; and 2) a label area in said rear facing portion, said label area including first and second generally parallel, mutually facing slots suitably spaced apart to retain said card when said first and second side edges of said card are inserted therein;

whereby, said card can be stored with said housing by sliding it into said slots before attaching said housing to the supporting surface such that said card can later be accessed by detaching said housing from the supporting surface and withdrawing said card from said slots.

2. The dangerous condition warning device of claim 1 in which said card is fabricated from plastic.

3. The dangerous condition warning device of claim 1 in which said card is fabricated from paper coated with plastic.

4. In a dangerous condition warning device adapted to issue an alarm when a sensed dangerous condition exceeds a predetermined status, which dangerous condition warning device has associated therewith protocol and instruction information which are intended to be permanently linked with said dangerous condition warning device for future reference, means for retaining said protocol and instruction information with said dangerous condition warning device comprising:

A) a card having instruction and protocol information printed thereon, said card having first and second generally parallel side edges and a third edge including a tab portion, said card being fabricated from a durable and flexible material; and B) a housing for said dangerous condition warning device, said housing being detachably attachable to a supporting surface for operational mounting, said housing including:

1) a base member having an outside surface including a rear facing portion disposed adjacent the supporting surface when said dangerous condition warning device is installed for normal operation; and 2) a label area in said rear facing portion, said label area including first and second generally parallel, mutually facing slots suitably spaced apart to retain said card when said first and second side edges of said card are inserted therein;

whereby, said card can be stored with said housing by sliding it into said slots before attaching said housing to the supporting surface such that said card can later be accessed by detaching said housing from the supporting surface and withdrawing said card from said slots using said tab portion.

5. The dangerous condition warning device of claim 4 in which said rear facing portion carries an AC plug such that said housing is detachably attachable to said supporting surface by plugging said AC plug into a corresponding socket disposed on said supporting surface.

6. The dangerous condition warning device of claim 5 in which said card is fabricated from plastic.

7. The dangerous condition warning device of claim 5 in which said card is fabricated from paper coated with plastic.

8. The dangerous condition warning device of claim 4 in which said card is fabricated from plastic.

9. The dangerous condition warning device of claim 4 in which said card is fabricated from paper coated with plastic.

* * * * *